United States Patent [19]

Tanimoto et al.

[11] Patent Number: 4,988,537

[45] Date of Patent: Jan. 29, 1991

[54] COATING METHOD

[75] Inventors: Yoshio Tanimoto; Tadamitsu Nakahama; Takakazu Yamane; Shunji Masuda, all of Hiroshima, Japan

[73] Assignee: Mazda Motor Corporation, Hiroshima, Japan

[21] Appl. No.: 328,544

[22] Filed: Mar. 24, 1989

[30] Foreign Application Priority Data

Mar. 25, 1988 [JP] Japan ..... 63-71337
Mar. 25, 1988 [JP] Japan ..... 63-71339

[51] Int. Cl.[5] ..... B05D 3/06

[52] U.S. Cl. ..... 427/46; 427/55; 427/379; 427/388.2; 427/409; 427/425

[58] Field of Search ..... 427/46, 55, 379, 388.1, 427/388.2, 388.4, 388.5, 409, 425

[56] References Cited

U.S. PATENT DOCUMENTS 4,610,898 9/1986 Engel et al. ..... 427/388.4 X
4,661,410 4/1987 Geist ..... 427/388.4 X
4,874,639 10/1989 Matsui et al. ..... 427/240
4,919,977 4/1990 Yamane et al. ..... 427/379

FOREIGN PATENT DOCUMENTS 2228 3/1976 Japan .
30581 2/1982 Japan .

*Primary Examiner*—Michael Lusignan
*Attorney, Agent, or Firm*—Wegner, Cantor, Mueller & Player

[57] ABSTRACT

A coating method contains a coating step for spraying the surface of a coating substrate paint with a paint and a drying step for drying the paint coated thereon. The paint coated on the substate is then caused to flow or sag artificially within the coat in the drying step by application of an action from the outside at least in one of the coating and drying steps, namely, by heating or vibrating the paint coated thereon. During the flowing or sagging of the paint artificially, the substrate is rotated about its axis extending substantially horizontally in a longitudinal direction of the substrate at a speed which is high enough to rotate the substrate before the paint coated thereon substantially sag due to gravity yet which is low enough so as to cause no sagging as a result of centrifugal force.

28 Claims, 20 Drawing Sheets

11
12
3
2
4
5b
5
1F
ℓ
12
11
3
2
W 1R
2
3
5a
5
4
ℓ
13
3
2
13
W

COATING METHOD

BACKGROUND OF THE INVENTION

1. Field of the Invention

The present invention relates to a coating method and, more particularly, to a coating method in which a paint coated on a coating substrate is caused to flow or sag artificially by an outside action while rotating the substrate about its horizontal axis at least in one of a step of coating the substrate with the paint and a step of drying the paint coated on the substrate.

2. Description of Related Art

The subject matter of this application is related to the subject matter of commonly-assigned and copending application Ser. No. 07/100,767, now U.S. Pat. No. 4,874,639, of application Ser. No. 07/153,669, now abandoned, and of application Ser. No. 07/323,237, now U.S. Pat. No. 4,919,977.

Technology relating to the rotation of a coating substrate after coating is disclosed in Japanese Utility Model Publication (kokoku) No. 2,228/1976, Japanese Patent Publication (kokai) Nos. 30,581/1982 and 67,332/1973 as well as U.S. Pat. No. 4,092,953.

Other technology relating to coating a coating substrate is disclosed in Japanese Utility Model Publication (kokai) Nos. 80,930/1983, 109,430/1984, and 21,361/1975, Japanese Utility Model Publication (kokoku) No. 20,053/1981, Japanese Patent Publication (kokai) No. 4,471/1984, as well as U.S. Pat. Nos. 1,948,091, 2,658,008, and 2,598,163.

A coating method for coating an outer surface of a coating substrate such as a vehicle body generally includes a preparation step for preparing for the coating substrate to be coated with a part by removing dust from the substrate, a coating step for coating the coating substrate with the paint, and a drying step for drying the paint coated thereon. The drying step generally comprises setting and baking steps particularly when a thermosetting paint is used. The setting step is usually carried out prior to the baking step at a temperature which is lower than the ambient temperature during the baking step, for example, at room temperature or at the temperature ranging from 40° C. to 60° C. in order to volatilize a solvent slowly so as to cause no pinholes on the coating surface during the baking step which is usually carried out at approximately 140° C.

The coating substrate is held at a given position on a conveyance means such as a carriage while being conveyed during the preparation, coating, and drying steps.

A degree of flatness or smoothness on the surface of a coating on the coating substrate is one of standards for evaluating a quality of the coat surface. The higher a degree of flatness the smaller a degree of irregularities on a coating surface, thus producing a better coating surface. It is well known that a thicker film thickness of a paint may give a higher degree of flatness on a coating surface. A paint sprayed on the surface of a coating may be said to sag if it is visually observed that the paint coated thereon flows and finds traces on the coating surfaces by 1 mm to 2 mm until it is cured in the drying step. It may be defined herein that sags of the paint occur if such traces exceed at least 2 mm when visually observed. In other words, a sagging limit thickness of a coating is a film thickness beyond the maximum film thickness in which the coating does not sag and the coating in its sagging limit thickness is caused to sag at least in the drying step if it is left as it is after spraying.

On the contrary, a film thickness of the paint within its sagging limit thickness is a film thickness in which it does not sag in the drying step even if it is left as it was sprayed.

It is known that sags or drips of a paint coated on the substrate during the coating step are detrimental to the quality of the coating surface. Such sags or drips are caused when the paint coated thereon flow downwardly due to gravity. They become more likely to occur if the paint is coated in a film thickness which becomes thicker in one coating.

And it is a matter of course that the sags are caused more likely on a coated surface extending in an up-and-downward direction than on a coated surface extending in a horizontal direction. This enables the paint to be coated on the surface extending horizontally in a film thickness which is thicker than on the surface extending in an up-and-downward direction because the sags or drips of the paint little affect adversely the coating surface extending in a horizontal direction. If the film thickness of a coat on the horizontally extending surface is the same as that on the surface extending in an up-and-downward direction, the former can produce a degree of flatness which is higher than the latter because the paint coated on the horizontally extending surface of a coating surface becomes flattened due to a natural flow in the paint to an extent to which no sags substantially occur.

Conventionally, in order to provide a coat with a higher degree of flatness while preventing sags or drips of a paint coated on the surface of a coating substrate, there have been used paints which are lower in viscosity and less flowable. Even if such thermosetting paints are used, however, a sagging limit of the paint coated on the surface extending in an up-and-downward direction is as high as approximately 40 μm. This sagging limit thickness, referred to sometimes as a sagging threshold value, is the maximum film thickness in which the paint does not substantially sag on the surface of a coating substrate extending in an up-and-downward direction.

Sags of the paint are likely to occur at initial stages of the setting and baking steps, particularly at the initial stage of the baking step so that a film thickness of a coat is determined by a film thickness of the paint coated on the surface of a coating substrate to such an extent that the paint does not sag on an up-and-downwardly extending surface thereof. Accordingly, in order to provide a coating in a film thickness larger than a sagging limit thickness of the paint, the coating step is repeated twice or more in the conventional coating method.

It is effective to rotate a coating substrate about its horizontal axis extending in a substantially horizontal direction of the substrate in order to provide a coating with a higher degree of flatness. In other words, even if the film thicknesses are the same, a coating with a higher degree of flatness may be given by utilizing a flowability of the paint in such a manner that a direction in which gravity acts upon a surface of the coating is artificially changed by rotating the substrate. This technology may produce a similar effect even if the paint is coated in a film thickness which is thicker than a sagging limit thickness of the paint to the contrary of conventional coating techniques.

SUMMARY OF THE INVENTION

Therefore, the present invention has the object to provide a coating method that produces a coat with a larger film thickness and with a higher degree of flatness on the surface of a coat than the surface of a coat which is obtained by the conventional method.

In order to achieve the object, the present invention involves altering a direction of the surface of a coating substrate in which gravity acts and utilizing a flowability of a paint coated on the surface thereof.

Thus the present invention consists of a coating method comprising: a coating step for spraying a surface of a coating substrate with a paint; and a drying step for drying the paint sprayed on the surface thereof; at least in one of the coating and drying steps an action is applied from outside so as to cause the paint coated thereon to flow or sag, while the substrate is rotated about its axis extending substantially horizontally in a longitudinal direction of the body at a speed which is high enough to rotate the body before the paint coated thereon substantially sags due to gravity yet which is low enough so as to cause no sagging as a result of centrifugal force.

In accordance with the present invention, the paint coated on the surface of the coating substrate is dried without sags or drips on the coat surface due to alteration of a direction of the coat surface in which gravity acts by rotating the coating substrate about its horizontal axis extending substantially horizontally in a longitudinal direction of the substrate.

The coating method according to the present invention permits a provision of a coat in a film thickness and with a degree of flatness by one coating, which is thicker and higher than that obtainable by the conventional coating method, respectively.

Furthermore, even if a film thickness of a coat coated on the coating substrate by the coating method according to the present invention is the same as that obtainable by the conventional method, the present invention provides the coat surface with a higher degree of flatness than that obtained by the latter.

If a coat surface has substantially the same degree of flatness as that obtainable by the conventional coating method, the coating method according to the present invention requires a film thickness thinner than that required by the conventional coating method, thus saving a quantity of the paint which is otherwise required to be consumed to a much greater extent.

The coating method according to the present invention is applicable to those paints used for the conventional coating method. Even if the paint is too flowable to be coated in a desired thin film thickness without sags or drips, it may be applied to the coating method according to the present invention if an ingredient such as a hybridizing agent which is added to increase its sagging threshold value would be reduced or removed from the conventional paint.

The coating method according to the present invention involves producing sags in an artificial manner from the outside at least in the coating or drying step. For this reason, even a paint that does not sag without actions from the outside may be used for the coating method according to the present invention. This enables a highly viscous paint to flow to such an extent to which the paint sags. This offers the great advantage that the paint coated in a film thickness which is thin enough to cause no sags in a usual state in the drying step can be caused to flow or sag during the drying step, as needed, thus making the paint coated thereon flowable and improving a degree of flatness on the coat surface. This coating method further presents the advantage that the time required for an interval, for instance, between the first coating and the second coating can be saved when the coating step is desired to be repeatedly carried out plurally. Furthermore, attention is little required to be paid to an ingredient of the paint. A combination of the rotation of the substrate with a flowability of the paint created during at least one of the coating and drying steps can improve a degree of flatness on the coat surface even if the paint is coated in a thin film thickness.

The outside action that may cause the paint coated on the surface of the coating substrate to flow or sag in an artificial manner may include heating or a vibration. In usual cases, a thermosetting paint is heated in the setting step at room temperature or at a temperature that is lower than that in the baking step. In the coating method according to the present invention, however, the setting step can be carried out at a temperature as high as the baking step. By heating the coat on the substrate in the setting step at the temperature as high as in the baking step, the paint which usually has not flown or sagged in the setting and baking steps can be caused to flow or sag within the coat in the setting step, thus enabling the coat surface to become flattened and causing no pinholes on the coat surface.

While the coating substrate undergoes the outside action to allow the paint coated thereon to flow or sag within the coat in an artificial manner, it is rotated about its horizontal axis. An angle at which the substrate is coated thereabout is at least as great as 10 degree with respect to an angle at which the substrate is mounted. The substrate may be rotated about its horizontal axis continuously or intermittently in one direction or in alternate directions.

The coating substrate may be rotated at a speed which is high enough to rotate the substrate before the paint flows down or sags over an acceptable sagging limit thickness due to gravity yet which is low enough so as to cause no sagging as a result of centrifugal force. Specifically, the acceptable sagging limit thickness is generally up to about 2 mm per minute, preferably up to 1 mm, when visually observed. If the paint is likely to flow down or sag at the rate exceeding the acceptable sagging limit, then the rotation of the substrate is reversed in the opposite direction. As a degree of flowing or sagging varies with the kind of a patient used, the maximum degree at which the paint does not flow or sag is determined experimentally in advance and the the speed of rotating the coating substrate is determined on the basis of the maximum degree of flowing or sagging obtained in advance experimentally.

DETAILED DESCRIPTION OF THE PREFERRED EMBODIMENTS

Outline of Coating Method

Figure 1:
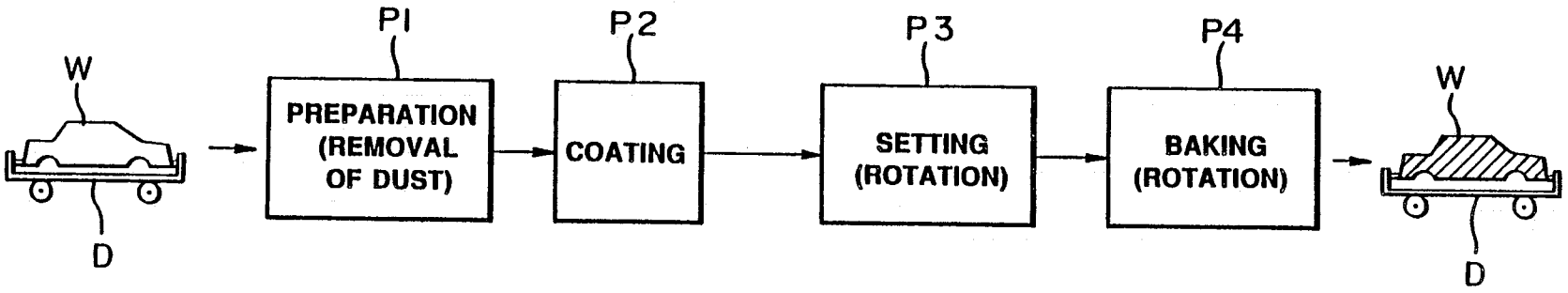
FIG. 1 is a schematic diagram showing an outline of the coating method according to the present invention.

FIG. 1 shows an outline of the whole steps of the coating method according to the present invention, in which a vehicle body W as a coating substrate is coated with a paint. As shown in FIG. 1, the coating method according to the present invention comprises roughly the the preparation step P1, the coating step P2, the setting step P3, and the baking step P4. In this specification, the terms "drying step" is intended to mean a sequential combination of the setting step P3 with the baking step P4, unless otherwise stated specifically.

The vehicle body W is first undercoated by conventional methods such as electrodeposition. The vehicle body W undercoated is conveyed on a carriage D to the preparation step P1. In the preparation step P1, dust and other foreign materials are removed from the inside and the outside of the vehicle body W, for example, by vacuum suction or air blowing for subsequent coating procedures. Then the vehicle body W is intercoated in conventional manner in the coating step P2 and the intercoated paint is cured in the setting step P3 and baked in the baking step P4. The body W so intercoated is then overcoated again in the coating step P2. Thereafter, the body W overcoated in cured in the setting step P3 and baked in the baking step P4. The overcoated vehicle body W is then conveyed to an assembly line.

Removal of Dust

In the preparation step P1, dust and other foreign materials are removed from the inside and outside of the vehicle body W by vacuum suction or air blowing. In the preparation step P1, the body W may be preferably rotated about its horizontal axis l, i.e., about an axis extending substantially horizontally in a longitudinal direction of the body W, as will be described in detail in conjunction with FIG. 2.

The rotation of the body W may readily remove dust and other foreign materials from corner portions inside a roof panel, a side sill and other partially closed sections which would not otherwise be removed without rotation of the body W.

Paints

The paints to be used for the coating method according to the present invention may be any paint which has been conventionally used for coating a coating substrate and may include, for example, thermosetting paints, two-component type paints, powder paints and so on. The paints may be conveniently chosen depending upon the kind of coating processes and the outside action to be applied as well as the speed of rotation. As needed, the paints may be used, for example, by adding a sags-preventing agent thereto or by diluting them with a solvent on site.

Particularly, paints to be used for coating the vehicle body W for an automobile may be ones having a number mean molecular weight ranging from about 2,000 to about 20,000 and include a solid coat of conventional type and of high solid type, a metallic base coat of conventional type and of high solid type, and a metallic clear coat of conventional type and of high solid type. The solid coat of an alkyd melamine resin of conventional type may have a number mean molecular weight ranging from about 4,000 to about 5,000 and of high solid type from about 2,000 to 3,000; the metallic base coat of an acrylic melamine resin of conventional type may have a number mean molecular weight from about 15,000 to about 20,000 and of high solid type from about 2,000 to about 3,000; the metallic clear coat of an acrylic melamine resin of conventional type may have a number mean molecular weight from about 5,000 to about 6,000 and of high solid type from about 2,000 to about 3,000; and the solid coat of a urethane isocyanate resin of conventional type may have a number mean molecular weight from about 7,000 to about 10,000 and of high solid type from about 2,000 to about 3,000. The paints having a number mean molecular weight below about 2,000, on the one hand, are in many cases of the type in which they are cured by electron beams or by ultraviolet rays and they are hard and frail, when cured, leading to the shortening of durability, because their density of cross-linkage is too high. Thus such paints are inappropriate for coating exterior panels of the vehicle body. The paints having a number mean molecular weight above 20,000 on the other, are of the type in which they have a very high viscosity so that they require a large amount of a solvent to dilute. Thus high costs are required to treat the solvent discharged. A latex polymer with a number mean molecular weight over 200,000 is not appropriate because its viscossity is elevated immediately after spraying, thus adversely affecting a degree of flatness on a coating surface.

Coating of The Paint

In the coating step P2, the paint may be sprayed on a surface of the coating substrate in a desired film thickness which is thinner or thicker than a sagging threshold value of a paint to be coated on the surface thereof.

If the conventional paint is used, it may be coated on the surface of the body W by spraying in a film thickness as thick as, for example, 35 μm, which is thinner than its sagging threshold value of about 40 μm, as have been described hereinabove. In this case, no sags or drips are caused and the paint little flows due to gravity, whereby the rotation of the body W is not necessarily required for the purpose of preventing sags only. In order to provide a coat surface with a higher degree of flatness, however, the paint coated thereon may be preferably rotated in a manner as will be described hereinafter.

The paint may be coated on the surface of the substrate by spraying in a film thickness as thick as, for example, 65 μm, which is thicker than its sagging threshold value. In this case, in order to prevent the paint from sagging, the substrate is rotated about its horizontal axis in a manner as will be described hereinbelow.

Drying of The Paint Coated

As have been described hereinabove, the drying step comprises sequential setting and baking steps P3 and P4.

a. Setting Step P3:

The vehicle body W coated with the paint in the coating step P2 is then conveyed on the carriage to the initial stage of the drying step, namely, to the setting step P3, where it is cured to a partial extent at a temperature ranging from 20° C. to 60° C. by slowly volatilizing a volatilizable solvent to form a highly surface coating for the body without pinholes.

Figure 16:
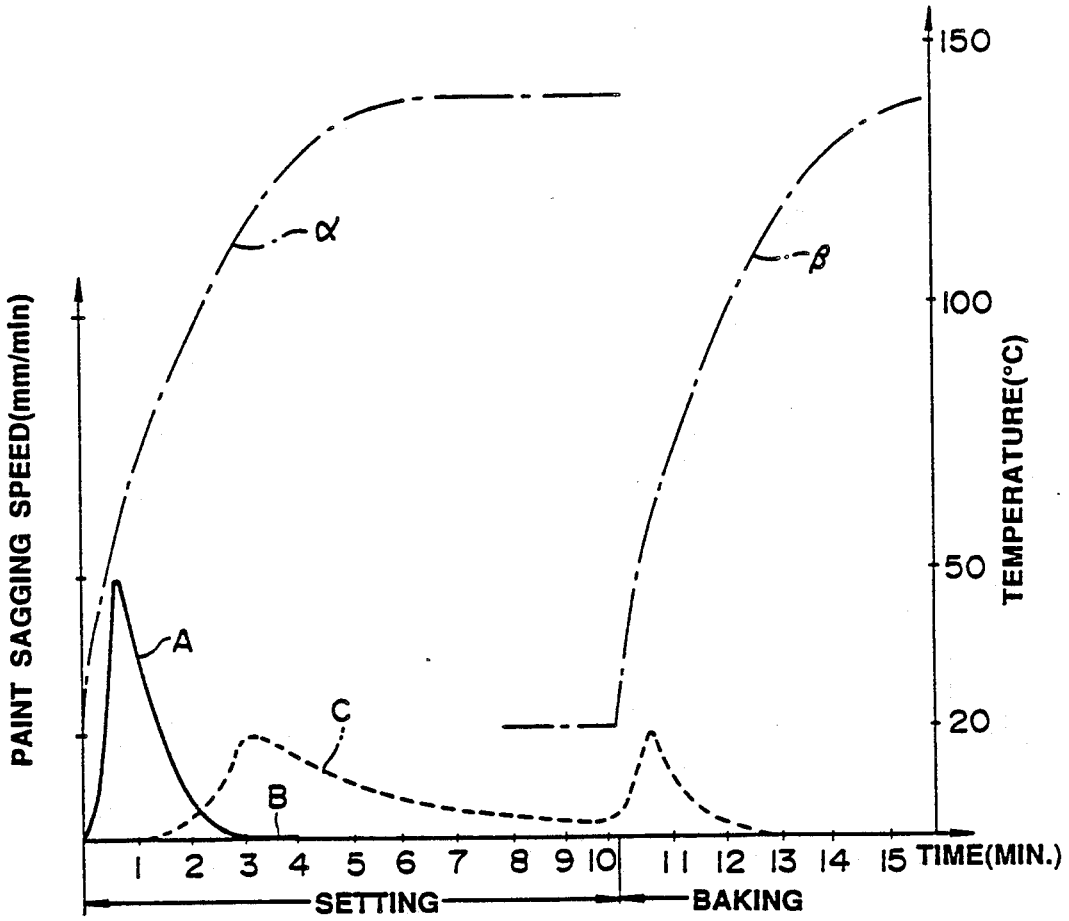
FIG. 16 is a graph showing the relationship of the setting and baking times vs. speeds at which the paint sags.

If the paint is coated on the body W in the coating step P2 in a film thickness thin enough to cause no sagging due to gravity yet to sag in an artificial manner by an action to be applied from the outside (thereinafter referred to sometimes as "outside action") in a manner as will be described hereinafter, the body W may be heated in the setting step P3 at a temperature which is substantially as high as the temperature during the baking step P4, for example along the line indicated by the dot-dash line α as shown in FIG. 16. The heating in the setting step P3 at such higher temperatures enables the paint coated thereon to flow in the coated paint causing sags even if the paint could not sag when coated in the film thickness below its sagging threshold value.

If the paint coated thereon in the coating step P2 is in a film thickness which is thicker than its sagging threshold value, the paint coated may be partially cured in an initial stage of the setting step P3 and then subjected to application of the outside action to cause sagging during the setting step P3.

Figures 2A, 2B, 2C, 2D, 2E, 2F, 2G, 2H, 2I:
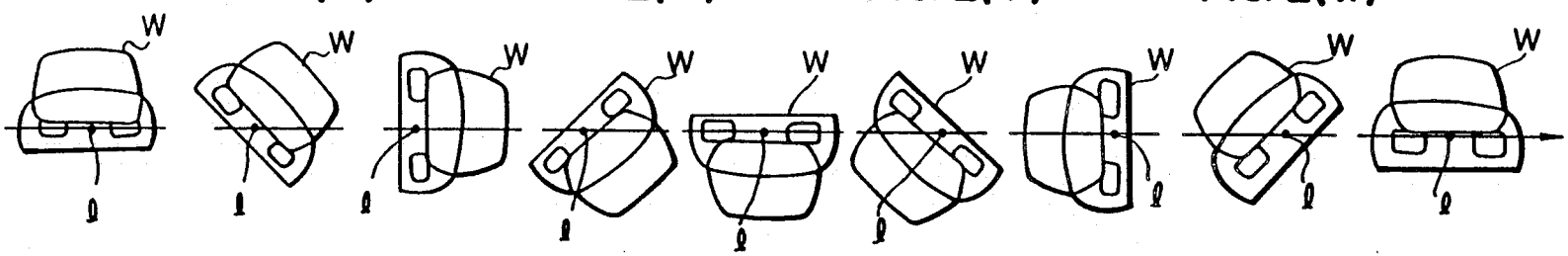
FIG. 2(*a*)–2(*i*) are schematic diagrams showing a variation of positions of a vehicle body at which it is rotated.

While the vehicle body W is treated by application of the outside action, the body W is rotated about its horizontal axis l in a manner as shown in FIG. 2 and as will be described more in detail.

b. Baking Step P4:

The vehicle body W set in the setting step P3 is then conveyed by the carriage to the baking step P4 where it is continued to be heated at substantially the same temperature as that at the final stage of the setting step P3 or where the temperature is elevated to baking temperatures, for example, along the dot-dash line indicated by β in FIG. 16.

If the paint coated on the substrate is still flowable to an extent that it sags by means of application of the outside action when the body W is conveyed to the baking step P4 from the setting step P3, the rotation of the coating substrate may be preferably carried out during the baking step P4 while the outside action is applied thereto.

If the coating on the surface of the substrate is cured to a sufficient extent during the setting step P3 and if the paint coated thereon does not substantially flow or sag, the rotation of the body W is not necessarily required. For the purpose of heating the coat surface uniformly, however, the body W may be rotated in a manner as will be described hereinafter.

Outside Action

The action to be applied from the outside at least in one of the coating step and the drying step may be any means that exercises an effect or influence upon an inner movement of a paint coated on the surface of a substrate in a direction in which the paint substantially flows or sags. Application of the outside action permits a provision of flowability of the paint coated thereon to wuch an extent that it sags even if the paint does not flow due to gravity. The action to be applied from the outside may include, for example, heating from various heating sources and a vibration such as a mechanical vibration or an acoustic vibration. In accordance with the present invention, the rotation of the substrate is carried out during application of the outside action thereto.

Rotation of the Coating Substrate

Referring to FIG. 2, FIG. 2(*a*) shows an original position at which the body W is mounted on the carriage. FIG. 2(*b*) shows a position of the body W in which it is rotated at 45 degrees from the original position of FIG. 2(*a*). FIGS. 2(*c*), (*d*), and (*e*) show positions at which it is rotated at 90 degrees, 135 degrees, and 180 degrees, respectively, from the original position thereof. As shown in FIGS. 2(*f*), (*g*), and (*h*), the body W is further rotated at 225 degrees, 270 degrees, and 315 degrees, respectively, from the original position shown in FIG. 2(*a*). FIG. 2(*i*) shows the position at which the body is rotated at 360 degrees from and returned to the original position of FIG. 2(*a*). It should be understood that FIG. 2 is shown merely as references and that the body W may take any position.

The rotation of the body W may be carried out on the carriage continuously or intermittently in one direction or in alternate directions in a cycle of rotation in which the body W is turned about its horizontal axis so as to allow every vertically cross-sectional portion of the body W passing through the center of its horizontal axis to pass equal occasions through the direction of gravity passing through the center thereof. If the body W is rotated in one direction, the rotation may be continously or intermittently carried out in a clockwise direction in FIG. 2, for example, in a cycle from the original position of FIG. 2(*a*) through FIGS. 2(*b*), (*c*), (*d*), (*e*), (*f*), (*g*), and (*h*) to the original position of FIG. 2(*i*). If it is rotated continuously or intermittently in alternate directions, the rotation may be carried out first in the clockwise direction in FIG. 2, for example, in a first quarter of one cycle from the original position of FIG. 2(*a*) through FIG. 2(*b*) to the position of FIG. 2(*c*) and then reversed back in a counterclockwise direction in a second quarter thereof from FIG. 2(*c*) through FIG. 2(*b*) to the original position of FIG. 2(*a*) and then in a third and quarter thereof from the original position of FIG. 2(*i*), i.e., FIG. 2(*a*), through FIG. 2(*h*) to the position of FIG. 2(*g*). In this case, the rotation of the body W is reversed again in a counterclockwise direction in a fourth quarter of one cycle from the position of FIG. 2(*g*) through FIG. 2(*h*) to the original position of FIG. 2(*i*), namely, FIG. 2(*a*). Furthermore, for example, if the rotation of the body W is reversed at the angle of 135 degrees, the body W is rotated first in a clockwise direction from the original position of FIG. 2(*a*) through FIGS. 2(*b*) and 2(*c*) to FIG. 2(*d*), and the rotation is reversed back in a counter-clockwise direction therefrom through FIGS. 2(*c*) and (*b*) to FIG. 2(*a*). The body W is continued to be rotated therefrom, namely, from FIG. 2(*i*) through FIGS. 2(*h*), (*g*) to FIG. 2(*f*) and then reversed again in a clockwise direction therefrom through FIGS. 2(*g*) and (*h*) to FIG. 2(*i*), namely, to the original position of FIG. 2(*a*). It is to be noted that the rotation of the body W may be reversed at any angle and it is not restricted at any means to those as have been described hereinabove.

As an angle at which the body W is rotated about its horizontal axis depends upon a degree to which the paint coated on the body W is flowable, it is to be noted that the rotation of the body W should be carried out at angles at which the paint coated thereon does not exceed its sagging limit, as will be described more in detail. If the paint would be likely to exceed its sagging limit while the body W is rotated in one direction, then the rotation of the body W should be reversed in the opposite direction to prevent the paint from dropping.

A speed of rotation of the body W is a speed which is high enough to rotate the body from a vertical position to a horizontal position before the paint coated thereon substantially sags due to gravity by allowing the gravity applied to the paint coated thereon to outweigh a viscosity of the paint as a result of application of the outside action rendering the paint flowable, yet which is low enough so as to cause no sagging as a result of centrifugal force. The maximum value for the speed of rotation is restricted to a range of speeds of rotation within which no sags are caused as a result of centrifugal force caused by the rotation of the body W on a coat of the paint a flowability of which becomes higher by application of the outside action. It is noted herein that the speed of rotation is determined on the basis of the maximum speed of paint sagging which in turn is preferably determined experimentally in advance. The relationship of the speed of rotation with a film thickness will be described in detail hereinbelow in conjunction with FIG. 26, and some discussion will be made therein on determination of the maximum speed of rotation vs. the film thicknesses of the paint.

Relationship of Film Thickness of Paint with Speed of Rotation

For the coating method according to the present invention, the maximum and minimum numbers of revolution of the vehicle body W may be determined per a film thickness of a paint to be coated on a surface of the body W. The maximum number of revolutions of the body W may be defined as the maximum value at which the paint coated is caused to sag as a result of centrifugal force, i.e., at the maximum value at which sags are caused as a result thereof, while the minimum number of revolutions of the body W may be defined as the minimum value at which the paint coated is not caused to sag, i.e., as the minimum value at which sags are prevented. The maximum value of revolutions thereof is reduced as a film thickness of the paint becomes thicker, while the minimum value thereof rises as a film thickness thereof becomes thicker. And the maximum film thickness of the paint may be defined as a value at which the maximum number of rotations coincides with the minimum number thereof.

Figure 3:
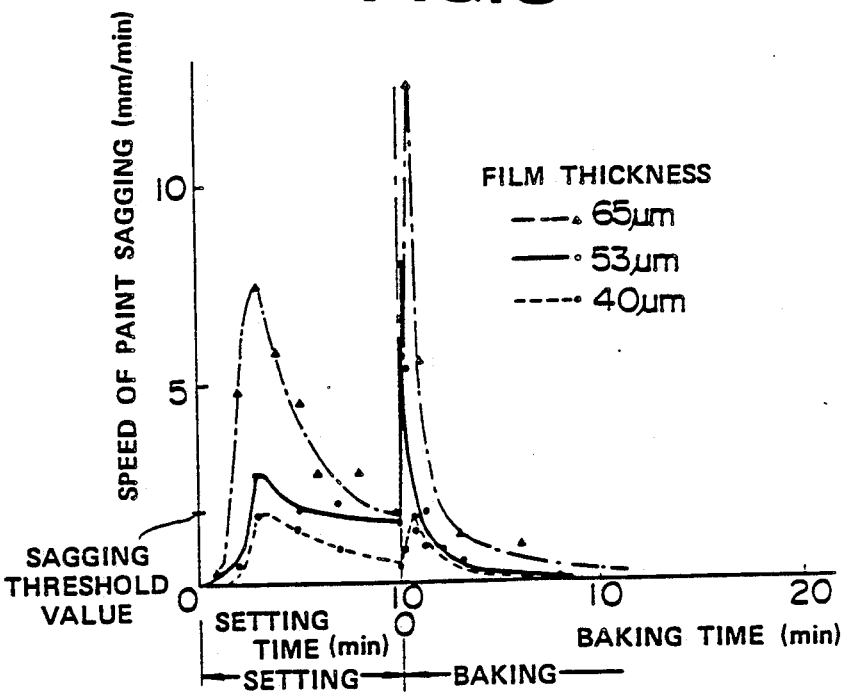
FIG. 3 is a graph showing the relationship of the setting and baking times vs. speeds at which the paint sags.
Figure 4:
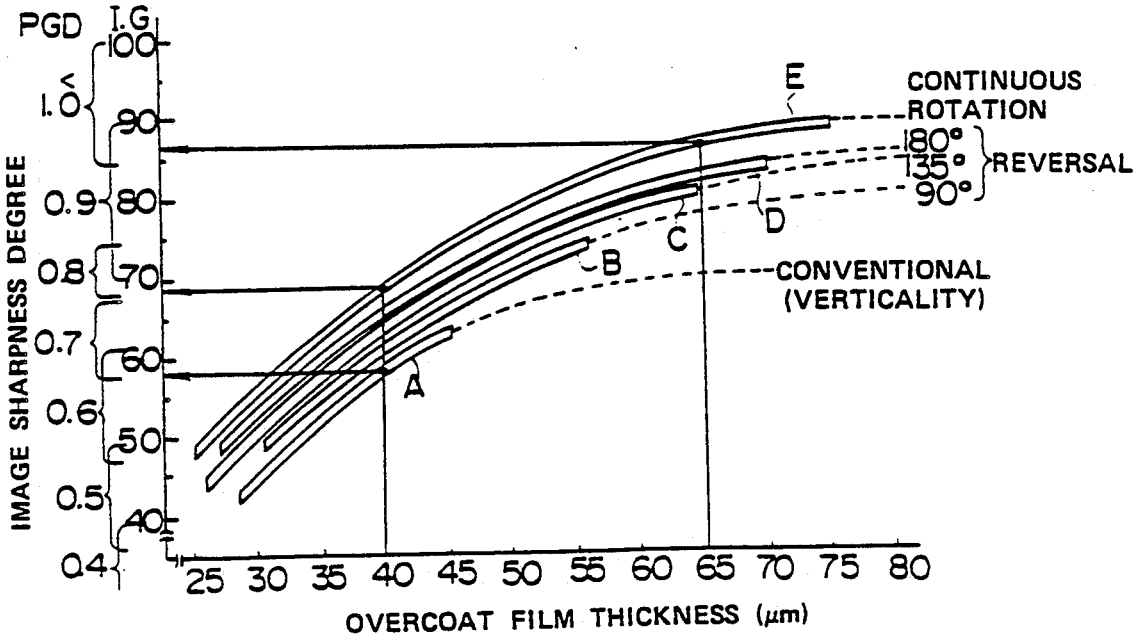
FIG. 4 is a graph showing the relationship of film thicknesses of the paint vs. degrees of image gross.
Figure 26:
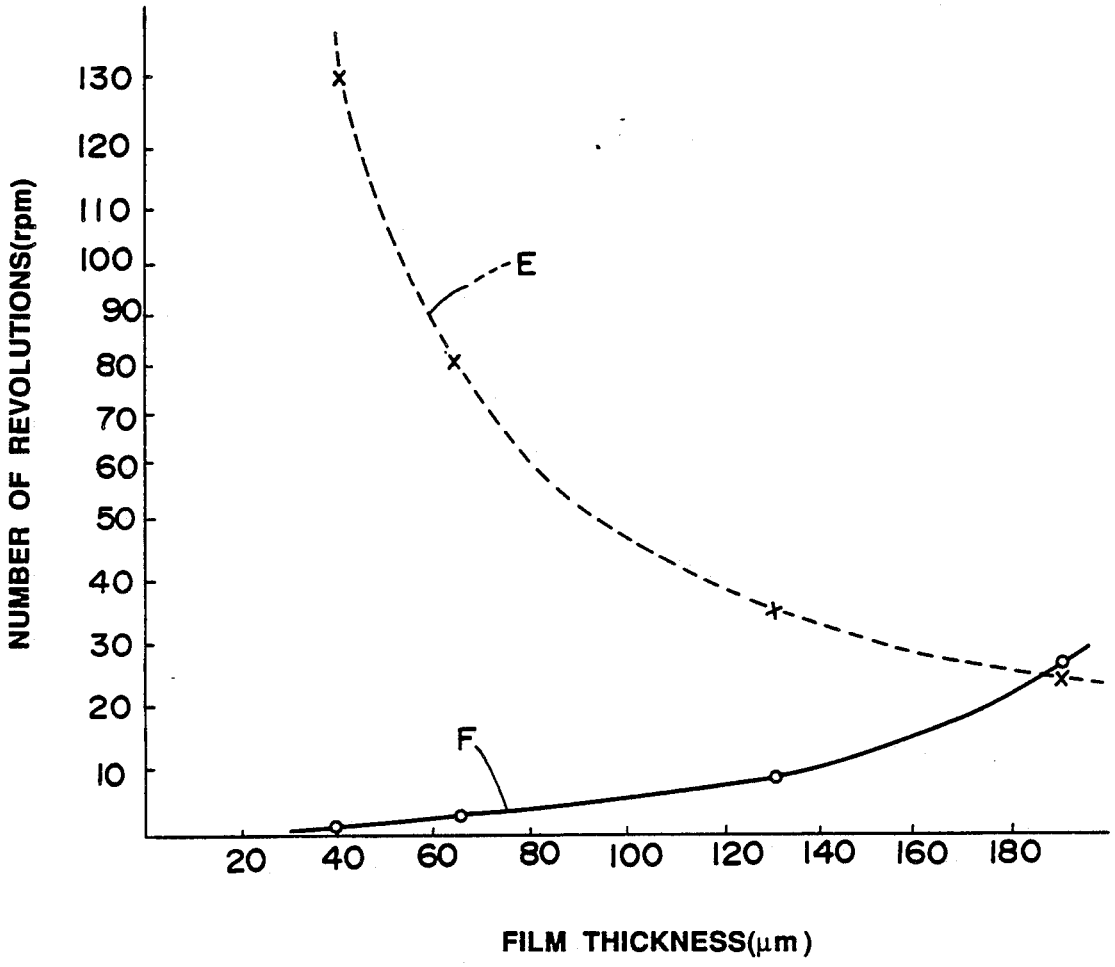
FIG. 26 is a graph showing the relationship of the number of revolutions vs. film thicknesses of coatings.

Referring now to FIG. 26, the dashed line E is shown to denote the maximum number of revolutions thereof and the solid line F is shown to denote the minimum number of revolutions thereof. The tests are carried out in the same conditions as in the tests done in accordance with the conditions as shown in FIGS. 3 and 4, provided that the test results are obtained when the test pieces were rotated in a rotational distance of 30 cm. It is to be noted that the relationship of the number of rotations with the distance may vary with the change of the distance because the speed of rotation at the tip of the substrate changes.

It has now been found from the test results as shown in FIG. 26 that the maximum film thickness of the paint so defined hereinabove is approximately 185 μm.

Relationship of Film Thickness of Paint with Speed of Paint Sagging

FIG. 3 demonstrates the influence of film thicknesses of a paint upon the speed at which the paint sags. The speeds of paint sagging are measured for three different film thicknesses of 40 μm, 53 μm, and 65 μm. As shown in FIG. 3, it has been found that a peak of the sagging speed appears at initial stages of the setting and baking steps in each case.

Relationship of Film Thickness with Degree of flatness

FIG. 4 shows the influence of the rotation of the vehicle body W about its horizontal axis upon degrees of flatness on the coat surface of the coating substrate expressed in a degree of image gross.

In FIG. 4, reference symbol A denotes a state of the coat surface obtained without the rotation of the vehicle body W in conventional manner. Reference symbol B denotes a state of the coat surface obtained by the rotation of the body W which is carried out in a clockwise direction at an angle of 90 degree, namely, from the position of FIG. 2(*a*) through FIB. 2(*b*) to FIG. 2(*c*) and then reversed in the opposite direction back to the original position of FIG. 2(*a*) from which, namely, from FIG. 2(*i*), the body W in turn is continued to be rotated in the same direction through FIG. 2(*h*) to FIG. 2(*g*)

and then turned again in the counterclockwise direction therefrom through FIG. 2(*h*) to the original position of FIG. 2(*i*). Reference symbol C demonstrates a state of the coat obtained when the rotation of the body W is carried out first in a clockwise direction at the angle of 135 degrees, namely, from the original position of FIG. 2(*a*) through FIGS. 2(*b*) and (*c*) to FIG. 2(*d*) and reversed in a counterclockwise direction therefrom through FIGS. 2(*c*), (*b*) to FIG. 2(*a*) from which, namely, from FIG. 2(*i*), the rotation is continued to FIG. 2(*h*) and then reversed again in a clockwise direction to the original position of FIG. 2. Reference symbol D demonstrates a state of the surface of the coat which was obtained by the rotation of the body W at the angle of 180 degrees in a clockwise direction from the position of FIGS. 2(*a*) to (*e*) and then by reversal of the rotation in a counterclockwise direction back to the original position of FIG. 2(*a*). In FIG. 4, reference symbol E shows a state of the coat surface obtained when the body W is continuously rotated around in one way from the original position of FIG. 2(*a*) through FIGS. 2(*b*), (*c*), (*d*), (*e*), (*f*), (*g*), and (*h*) to the original position of FIG. 2(*i*), namely, FIG. 2(*a*).

As shown in FIG. 4, it is found that higher degrees of flatness on the coat surfaces are given when the body W is rotated as in the cases of reference symbols B, C, D and E, than reference symbol A, if the film thicknesses are the same. It is also found that a higher degree of flatness can be produced when the body W is rotated continuously in one direction at the angle of 360 degrees than when the rotation is carried out in one direction and then reversed in the opposite direction or directions. It is further found in the result shown in FIG. 4 that the coat obtainable without rotation of the body W is thin in a film thickness, thus leading to a lower degree of flatness and producing a limit upon thickening its film thickness.

When the film thickness of 65 μm was formed on the body W by rotating continuously in one direction at the angle of 360 degrees, a degree of flatness is "87" when expressed in an image gloss (I.G.) as a degree of image, namely, the lowest limit value when the PGD value is 1.0. In the case of the coat in the film thickness of 40 μm formed without rotation, a degree of flatness is "58" when expressed in the image gloss (I.G.), or the lowest limit value when the PGD value is 0.7, while the coat in the film thickness of 40 μm formed by the continuous rotation in one direction at the angle of 360 degrees provides a degree of flatness which is "68" when expressed in the image gloss (I.G.) as a degree of image sharpness, or the lowest limit value when the PGD degree is 0.8. It is understood that the definition for the image gloss (I.G.) in the image sharpness degree is a percentage of an image sharpness on an objective coat surface on the basis of the image gloss of "100" when a mirror surface of a black glass is used, and a PGD value is a value rating identification degrees of reflected images from 1.0. The PGD value gets lower as the degree of flatness gets lower.

The data shown in FIGS. 3 and 4 were obtained by overcoating in the coating step P2 above under following test conditions:

(a) Paint: melamine alkid (black)

Viscosity: 22 seconds/20° C. (measured by Ford Cup #4)

(b) Film coater: Minibell (16,000 r.p.m.)

Shaping air: 2.0 kg./cm$^2$ c)

(c) Spraying amounts: sprayed two times

First time: 100 cc/minute

Second time: 150–200 cc/minute (d) Setting time/temperature: 10 minutes/room temperature (e) Baking temperature/time: 140° C./25 minutes (f) Degree of flatness on overcoat surface: 0.6 (PGD) (intercoat on PE tape)

(g) Time period for rotation and reversal: 10 minutes (for the setting step) 10 minutes (for the baking step)

(h) Coating Substrate: The side surfaces of a square pipe with a 30 cm side are coated and supported rotatably at its center.

(i) Rotational speeds: 6, 30, and 60 r.p.m.

It is found that there is no variation in degrees of flatness on the coat surfaces obtained by the different speeds of rotation.

Oven

Figure 17:
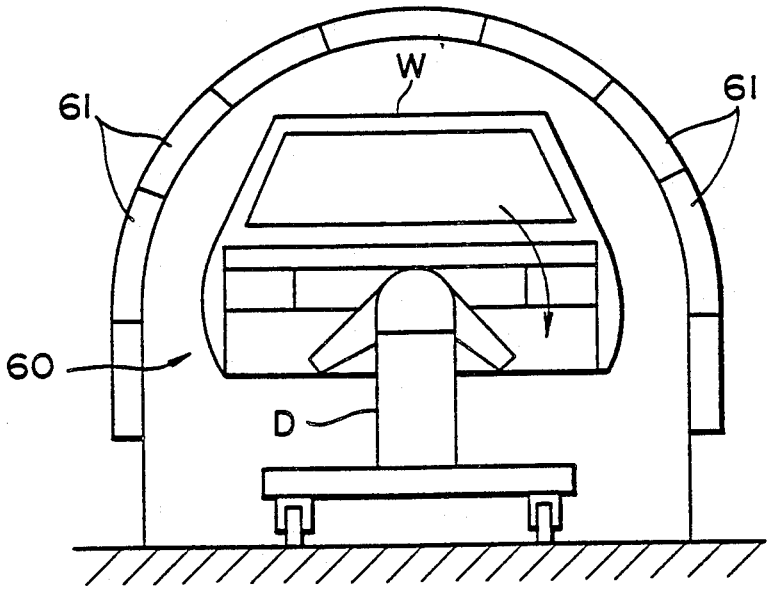
FIG. 17 is a view showing a preferred example of an oven for drying the paint coated on the vehicle body.
Figure 18:
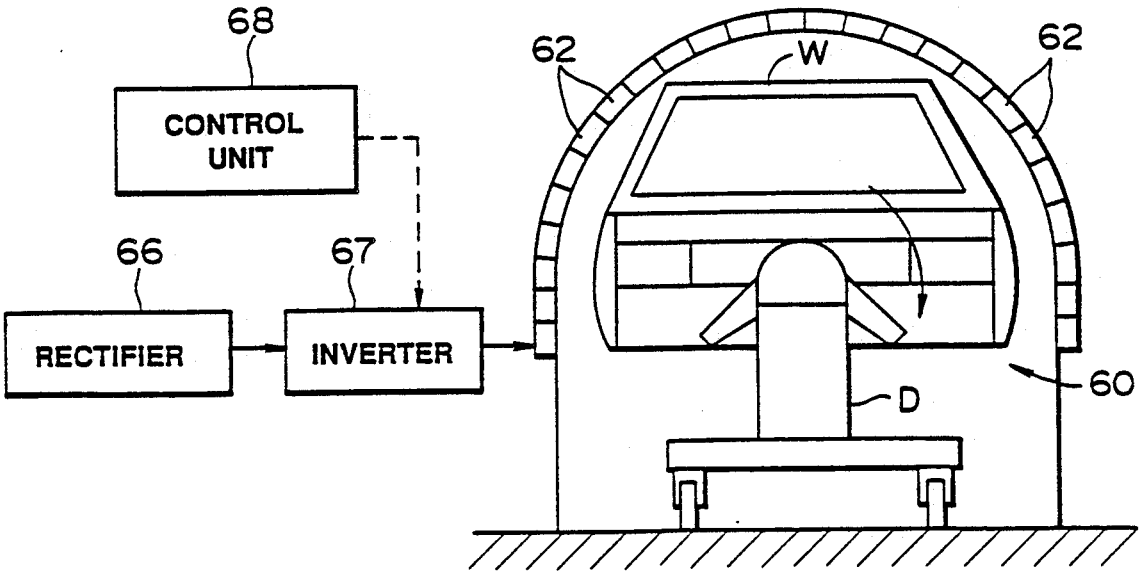
FIG. 18 is a view showing a combination of the oven of FIG. 18 with a system.

The paint coated on the surface of the coating substrate such as the vehicle body is heated in an over 60 as shown in FIGS. 17 and 18 in the setting step P3—when it is heated at the temperature as high as that during the baking step P4—and in the baking step P4.

As shown in FIG. 17, the oven 60 may be designed to cover right-hand and left-hand sides and a top side of the vehicle body W with a housing consisting of a number of infrared panels 61. As shown in FIG. 18, it may also be designed to use a housing consisting of high-frequency induction coils 62 in place of the infrared panels used for the oven in FIG. 17. In both cases, it is preferred to heat the top side of the body W at sufficiently elevated temperatures in order to prevent a convection of air within the oven and to avoid occurrence of floating dust as much as possible. As shown in FIG. 18, the oven is designed to apply electricity to the coils 62 through a rectifier 66 and an inverter 67, and to control a magnetic field constant by regulating the inverter 67 by a control unit 68. The oven of the type as shown in FIG. 18 is preferably employed in order to heat the body W in a uniform manner because the magnetic field can be held constant in correspondence with a change in a clearance between the body W and the coils 62 attendant upon the rotation of the body W.

Figure 19:
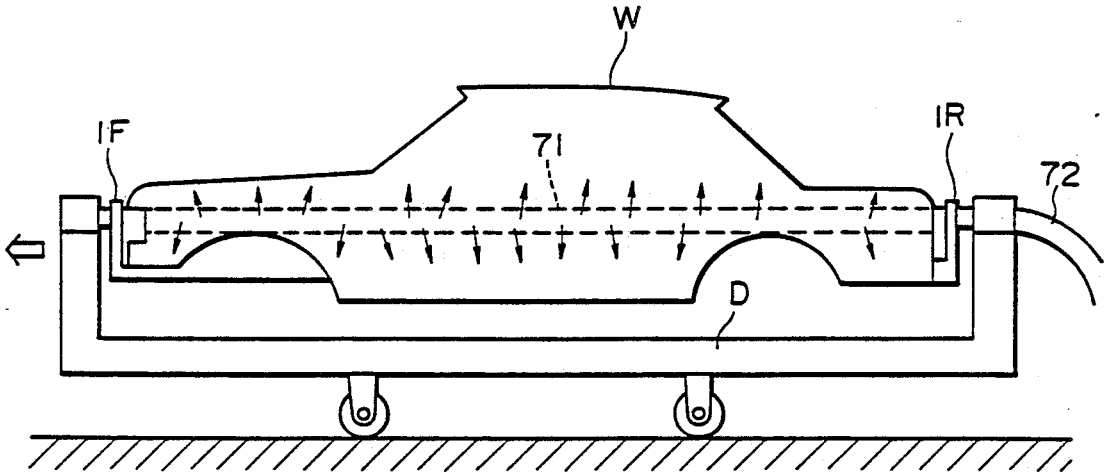
FIG. 19 is a view showing a preferred manner in which the vehicle body is dried.

FIG. 19 shows an example of a heating system in which the vehicle body W is heated from the inside. Together with this heating system, the oven of the type as shown in FIGS. 17 and 18 or any other oven of the type used conventionally may be employed. The heating system as shown in FIG. 19 is such that a hollow cylinder member 71 with a number of small holes is detachably mounted within the body W by connecting its both ends to a pair of front and rear rotation jigs 1F and 1R, respectively, disposed on the carriage. Warm air is blown in the hollow cylinder member 71 through a hose 72 connected through a rotary joint (not shown) to the cylinder member 71 and further into the inside of the body W through the holes provided on the cylinder member 71. With this arrangement, the body W may be heated from the inside in addition to from the outside.

Rotation Jig

The vehicle body W is mounted horizontally on the carriage through a pair of rotation jugs so as to be rotatable about its axis extending horizontally in a longitudinal direction of the body W.

Figure 5:
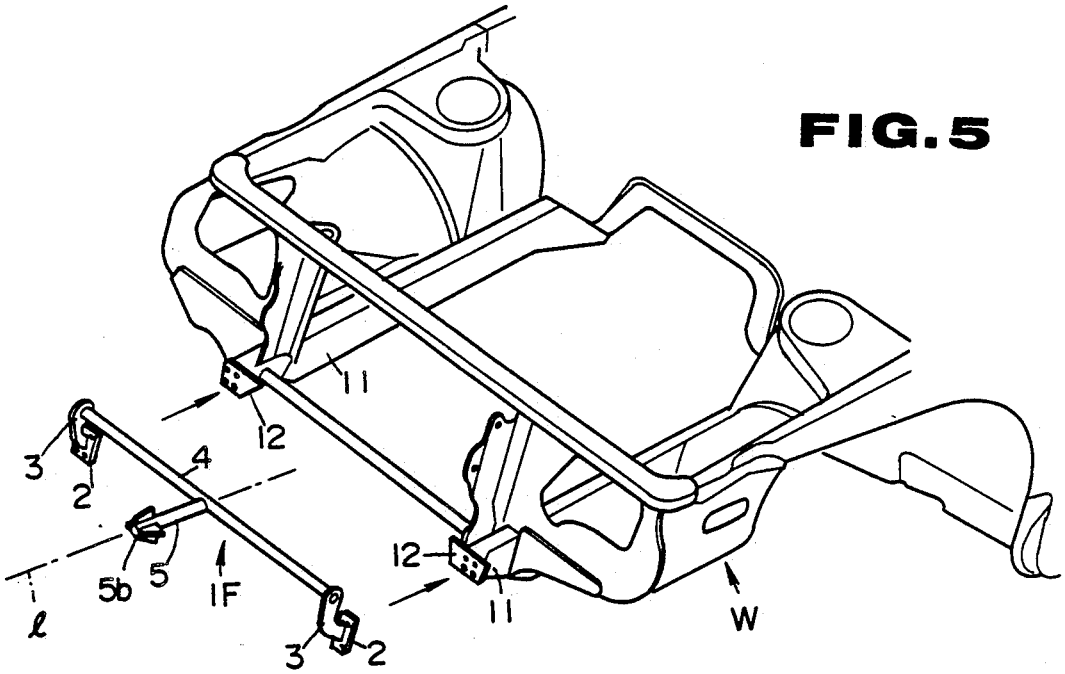
FIG. 5 is a perspective view showing a front jig for rotating the vehicle body.

FIG. 5 shows a front rotation jig 1F for horizontally supporting a forward portion of the body W. The front rotation jig 1F comprises a pair of left-hand and right-hand mounting brackets 2, a pair of left-hand and right-hand stays 3 welded to the corresponding left-hand and right-hand mounting brackets 2 and a connection bar 4 for connecting the pair of the stays 3, and a rotary shaft 5 connected integrally to the connection bar 4. The front rotation jig 1F is fixed at its portions of the brackets 2 to a forward end portion of a front reinforcing member of the vehicle body W such as a front side frame 11. To the front side frame 11 is usually welded mounting brackets 12 for mounting a bumper (not shown), and the brackets 2 are fixed with bolts (not shown) to the brackets 12 on the side of the body W.

Figure 6:
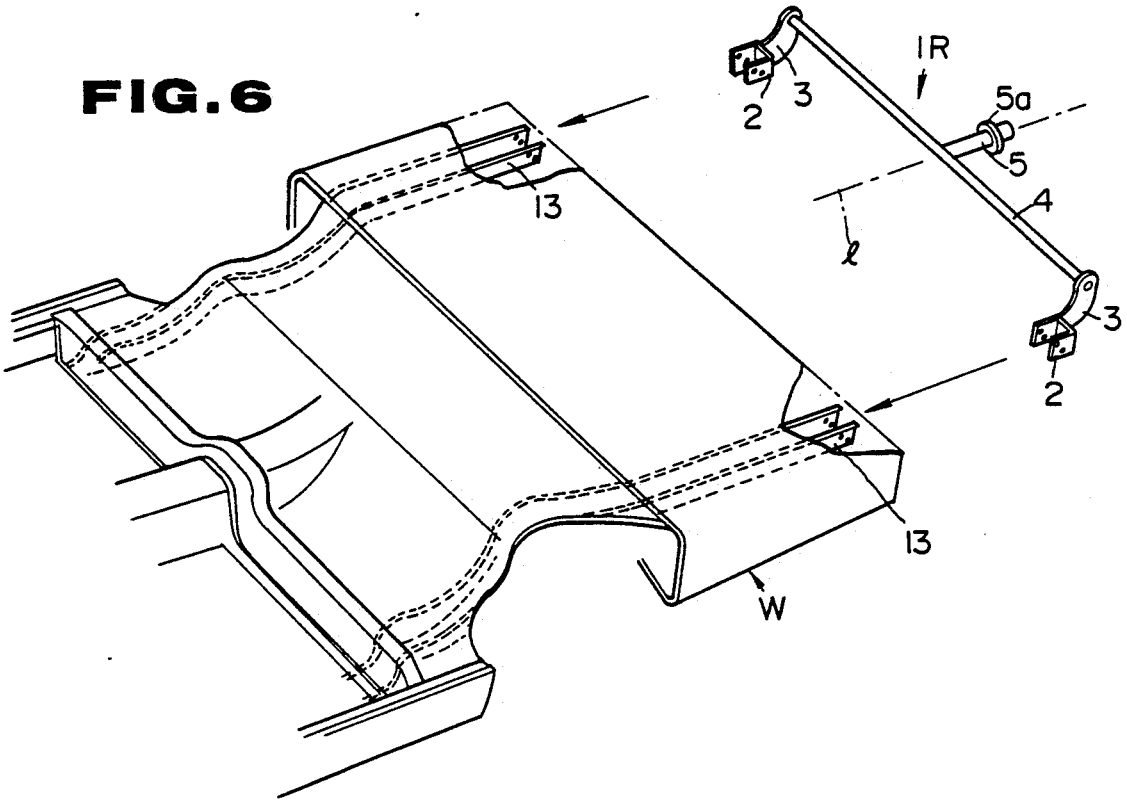
FIG. 6 is a perspective view showing a rear jig for rotating the vehicle body.

FIG. 6 shows a rear rotation jig 1R for horizontally supporting a rearward portion of the vehicle body W, which substantially the same structure as the front rotation jig 1F. In the drawing, the same elements for the rear rotation jig 1R as for the front rotation jig 1F are provided with the same reference numerals as the latter. The mounting of the rear rotation jig 1R to the vehicle body W is effected by fixing brackets 2 with bolts (not shown) to the floor frame 13 disposed at a rearward end portion of the vehicle body W as a rigidity adding member. Alternatively, the rear rotation jig 1R may be mounted to the body W through a bracket for mounting the bumper, the bracket being welded to a rearward end portion of the floor frame 13.

Figure 7:
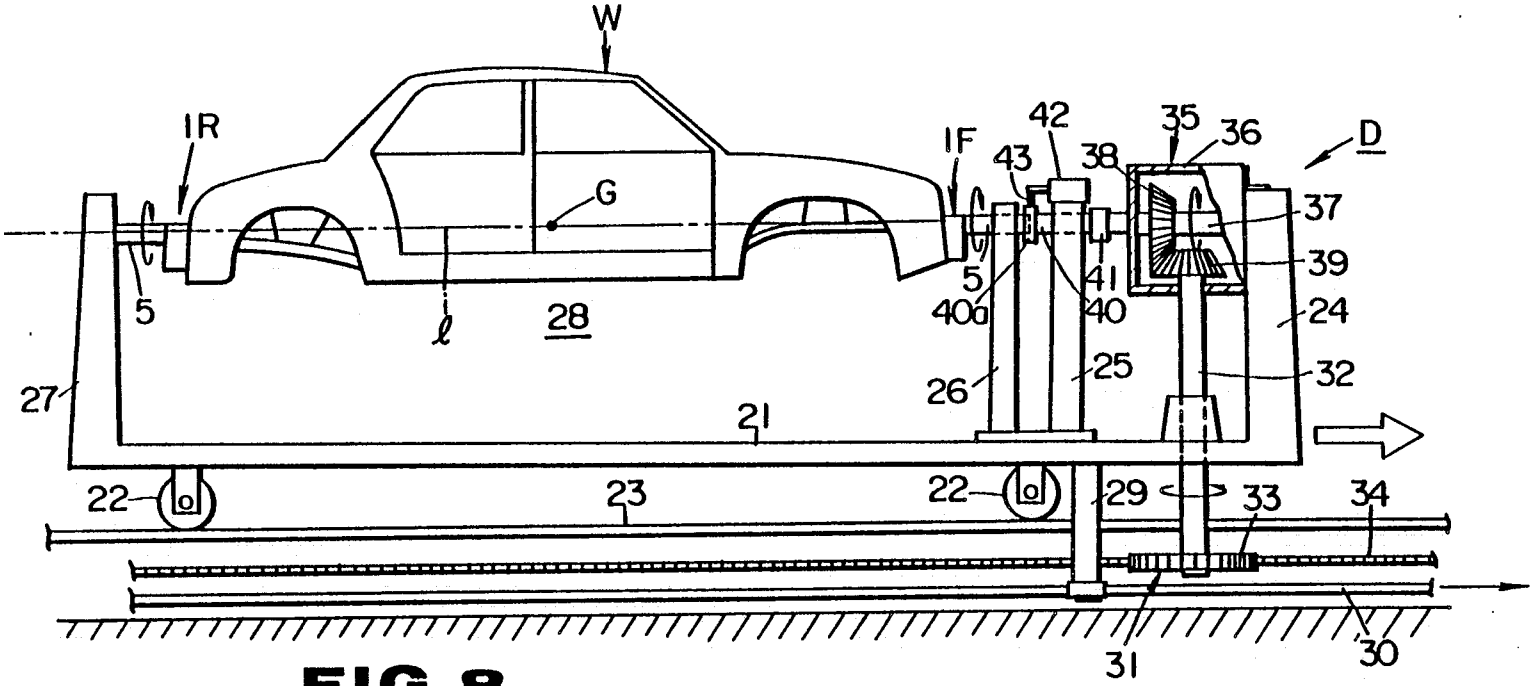
FIG. 7 is a side view showing the side portion of a vehicle-body conveying carriage for rotating the vehicle body.
Figure 9:
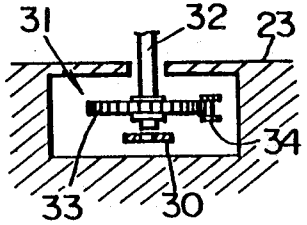
FIG. 9 is a cross-sectional view taken along line X9—X9 of FIG. 8.
Figure 8:
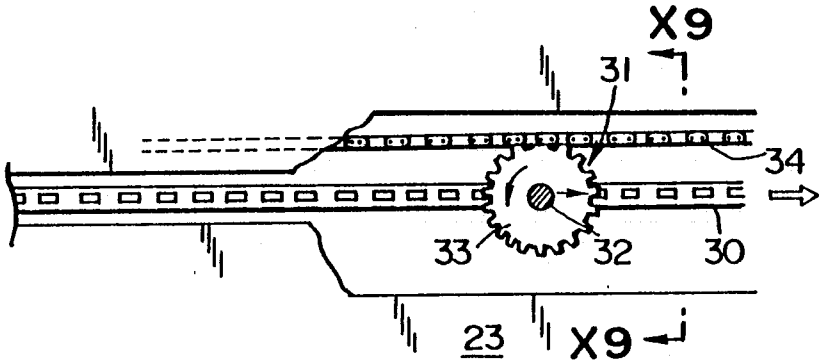
FIG. 8 is a partially cut-out plane view showing the structure of a conveying means underneath a passageway on which the carriage travels.

The front and rear rotation jigs 1F and 1R are mounted to the body W in such a manner that their respective rotary shafts 5 extend horizontally on the same straight line in its longitudinal direction when the body W is mounted on the carriage D through the front and rear rotation jigs 1F and 1R. The very straight line is the horizontal axis l about which the body W is rotated. It is preferred that the horizontal axis is designed so as to pass through the center of gravity G of the body W as shown in FIG. 7. The arrangement for the horizontal axis l to pass through the center of gravity G serves as preventing a large deviation of a speed of rotation. This can prevent an impact upon the body W accompanied with the large deviation in rotation, thus preventing the paint coated from sagging.

The front and rear rotation jigs 1F and 1R may be prepared for exclusive use with the kind of vehicle bodies.

Carriage

The carriage which will be described hereinbelow is a carriage that may be used at least during the coating step P2 and/or in the setting step P3 and that is provided with a mechanism for rotating or turning the vehicle body W about its horizontal axis l extending in a longitudinal direction thereof.

Referring to FIG. 7, the carriage D is shown to include a base 21 and wheels 22 mounted to the base 21 with the wheels 22 arranged to operatively run on rails 23. On the base 21 is mounted one front support 24, two intermediate supports 25 and 26, and one rear support 27, each standing upright from the base 21, as shown in the order from the forward side to the rearward side in a direction in which the vehicle body W is conveyed. Between the intermediate supports 25, 26 and the rear support 27 is formed a space 28 within which the body W is mounted through the front and rear rotation jigs 1F and 1R.

The vehicle body W is loaded in the space 28 and supported rotatably at its forward portion by the intermediate support 26 through the front rotation jig 1F and at its rearward portion by the rear support 27 through the rear rotation jig 1R.

Figure 10:
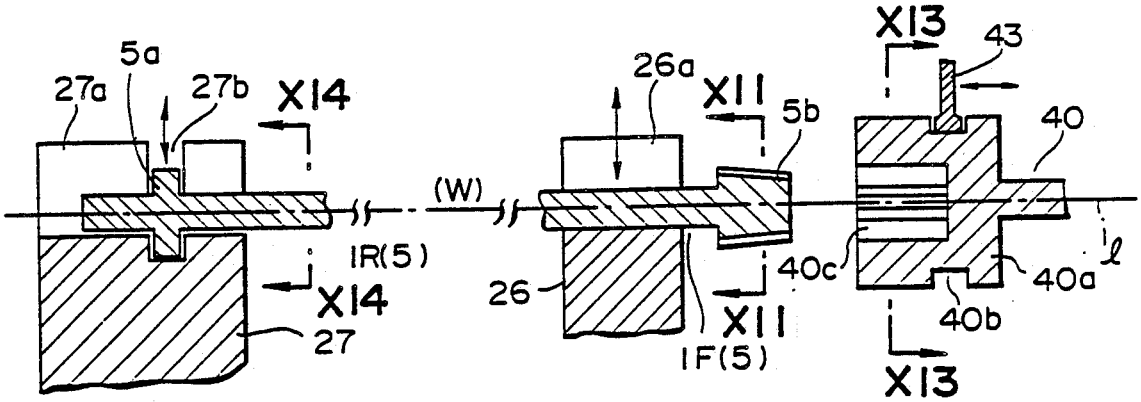
FIG. 10 is a cross-sectional side view showing a connecting portion at which the carriage is connected to a rotary jig.
Figure 11:
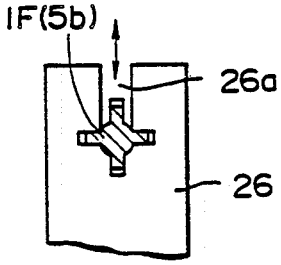
FIG. 11 is a cross-sectional view taken along line X11—X11 of FIG. 10.
Figure 13:
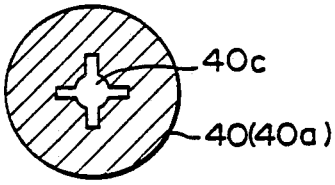
FIG. 13 is a cross-sectional view taken along line X13—X13 of FIG. 10.
Figure 12:
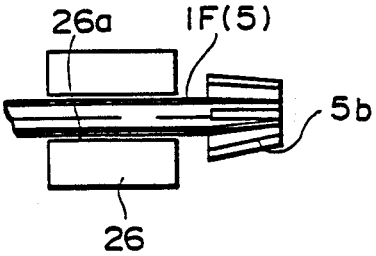
FIG. 12 is a plane view of FIG. 10.

As shown in FIGS. 10, 11, and 12, on the one hand, the intermediate support 26 is provided at its top surface with a groove 26*a* which in turn is designed so as to engage or disengage the rotary shift 5 of the front rotation jig 1F with or from the support 26 in a downward direction or in an upward direction.

Figure 14:
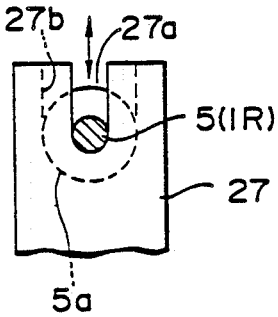
FIG. 14 is a cross-sectional view taken along line X14—X14 of FIG. 10.
Figure 15:
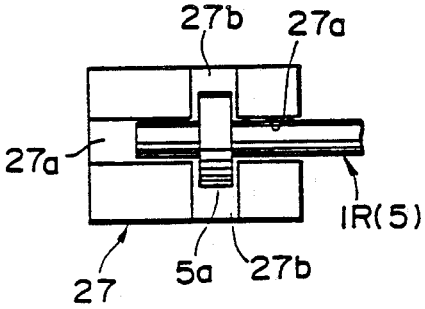
FIG. 15 is a plane view of FIG. 14.

As shown in FIGS. 10, 14, and 15, on the other hand, the rear support 27 is provided at its top surface with a groove 27*a* which engages or disengages the rotary shaft 5 of the rear rotation jig 1R with or from the rear support 27. The rear rotation jig 1R is further provided with a groove 27*b* in a shape corresponding to a flange portion 5*a* provided on the rotary shaft 5 of the rear rotation jig 1R, the groove being communicated with the groove 27*A*.

This arrangement permits the engagement or disengagement of the rotary shifts 5 with or from the front and rear rotation jigs 1F and 1R in a downward direction or in an upward direction, but it allows the rear rotation jig 1R to be unmovable in a longitudinal direction in which the horizontal axis extends due to a stopper action of the flange portion 5*a*.

As shown in FIGS. 10, 11, and 12, the rotary shaft 5 of the front rotation jig 1F is provided at its end portion with a connection portion 5*b* through which a force of rotation of the rotary shaft 5 of the front rotation jig 1F is applied to the vehicle body W, as will be described hereinbelow.

From the base 21 extends downwardly a stay 29 to a lower end portion of which is connected a retraction wire 30. The retraction wire 30 is of endless type and is drivable in one direction by a motor (not shown). The retraction wire 30 thus drives the carriage D in a predeterminated direction in which the body W should be conveyed. The motor should be disposed in a safe place from the viewpoint of security from explosion.

The rotation of the vehicle body W may be carried out using a movement of the carriage D, that is, using a displacement of the carriage D with respect to the rails 23. The displacement of the carriage D may be converted to a force of rotation using a mechanism 31 for converting the displacement of the carriage D into rotation. The mechanism 31 comprises a rotary shaft 32 supported rotatably by the base 21 and extending in a vertical direction from the base 21, a sprocket 33 fixed on the lower end portion of the rotary shaft 32, and a chain 34 engaged with the sprocket 33. The chain 34 is disposed in parallel to the retraction wire 30 in such a state that it does not move along the rails 23. As the carriage D is retracted by the retraction wire 30, the sprocket 33 allows the rotary shaft 32 to rotate because the chain 34 is unmovable.

A force of rotation of the rotary shaft 32 is transmitted to the rotary shaft 5 of the front rotation jig 1F through a transmitting mechanism 35 which comprises a casing 36 fixed on a rearward side surface of the front support 24, a rotary shaft 37 supported rotatably to the casing 36 and extending in a longitudinal direction of the body W, a pair of bevel gears 38 and 39 for rotating the rotary shaft 37 in association with the rotary shaft 32, and a connection shaft 40 connected to the front support 25 rotatably and slidably in the longitudinal direction thereof. The connection shaft 40 is spline connected to the rotary shaft 37, as indicated by reference numeral 41 in FIG. 7. This construction permits a rotation of the connection shaft 32 to rotate the rotary shaft 40. It is understood that the rotary shaft 37 and the connection shaft 40 are arranged so as to be located on the horizontal axis l extending in a longitudinal direction of the body W. The connection shaft 40 is connected to or disconnected from the front rotary shaft 5 of the front rotation jig 1F. More specifically, as shown in FIGS. 10 to 12, the front rotary shaft 5 of the front rotation jig 1F is provided at its end portion with a connecting portion 5*b* in a cross shape, while the connection shaft 40 is provided at its end portion with a box member 40*a* having an engaging hollow portion 40*c* that is engageable tightly with the connection portion 5*b* of the front rotary shaft 5 as shown in FIGS. 10 and 12. By slidably moving the connection shaft 40 by a rod 43, for example, using a hydraulic cylinder 42, the connection portion 5*b* is connected to or disconnected from the box member 40*a* at its engaging hollow portion 40*c*. The connection shaft 40 is rotatable integrally with the rotary shaft 5. The rod 43 is disposed in a ring groove 40*b* formed on an outer periphery of the box member 40*a*, as shown in FIG. 10, in order to cause no interference with the rotation of the connection shaft 40. With the above arrangement, the front and rear rotary shafts 5 of the respective front and rear rotation jigs 1F and 1R are supported by the intermediate support 26 and the rear support 27 so as to be rotatable about the horizontal and longitudinal axis yet unmovable in a longitudinal direction of the body W, when the body W is lowered with respect to the carriage D in a state that the connection shaft 40 is displaced toward the right in FIG. 7. Thereafter, the connection portion 5*b* of the rotary shaft 5 is engaged with the connection shaft 40 through the engaging hollow portion 40*c* thereof, whereby the body W is allowed to rotate about the predetermined horizontal axis l by retracting the carriage D by means of the retraction wire 30. The vehicle body W can be unloaded from the carriage D in the order reverse to that described above.

Figure 20:
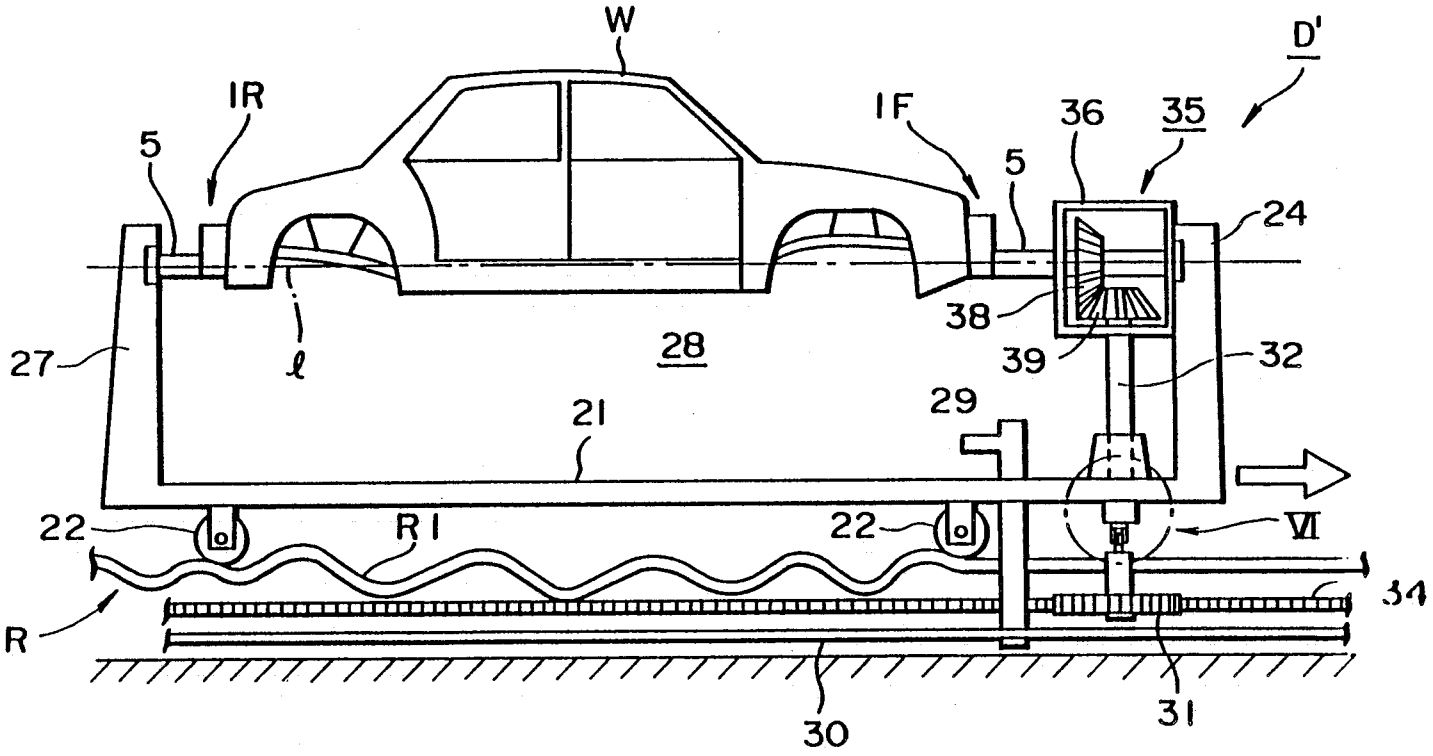
FIG. 20 is a side view showing a carriage with the vehicle body mounted thereon and a passageway on which the carriage travels.

Referring now to FIG. 20, there is shown another example of a combination of a carriage D' with rails on which the carriage D' travels. The carriage D' has substantially the same structure as the carriage D shown in FIG. 7 so that the same elements are provided with the same reference numerals and symbols and that a description on those elements are omitted for brevity of description.

In this example, the rails R are designed to be of a waveform shape curved upwardly and downwardly, as indicated by paint sagging, namely, a speed in which the paint sags, becomes high. Such an area may be the setting step P3 and an initial stage of the baking step P4. The other range of the rails R is straight. While the carriage D' travels a waveform range of the rails R1, it is swung substantially in upward and downward directions.

Figure 21:
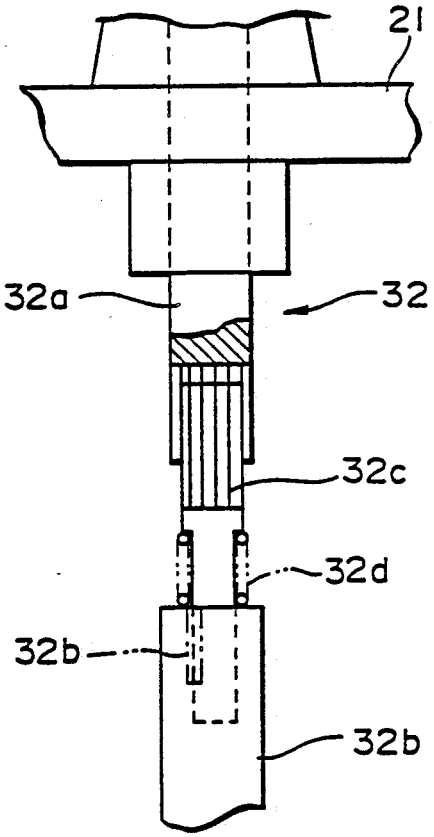
FIG. 21 is a cross-sectional view showing the detail of the portion indicated by reference symbol VI in FIG. 20.

As shown in FIG. 21, a mechanism 35 for converting an upward-and-downward movement to rotation may be designed to comprise a rotary shaft 32 consisting of an upper rotary shaft portion 32*a* and a lower rotary shaft portion 32*b*, and the upper rotary shaft portion 32*a* is spline connected to the lower rotary shaft portion 32*b*. A spline-connectable portion 32*c* of the lower rotary shaft portion 32*b* is displaceable vertically, and a compression spring 32*d* is interposed between the spline-connectable portion 32*c* and the main body of the lower rotary shaft portion 32*b*, thus urging the spline-connectable portion 32*c* always in an upward direction. In the drawings, reference numeral 32*e* denotes a key.

The above arrangement for the combination of the carriage D' with the rails R permits the rotation of the body W about its horizontal axis l and a vibration of the carriage D' in an upward-and-downward movement, thus enabling the paint coated to be vibrated during the setting step P3 and/or during the initial stage of the baking step P4. The vibration of the carriage D' changes a direction in which gravity acts on the paint coated, thus altering the absolute value of a force acting upon the paint coated.

Figure 22:
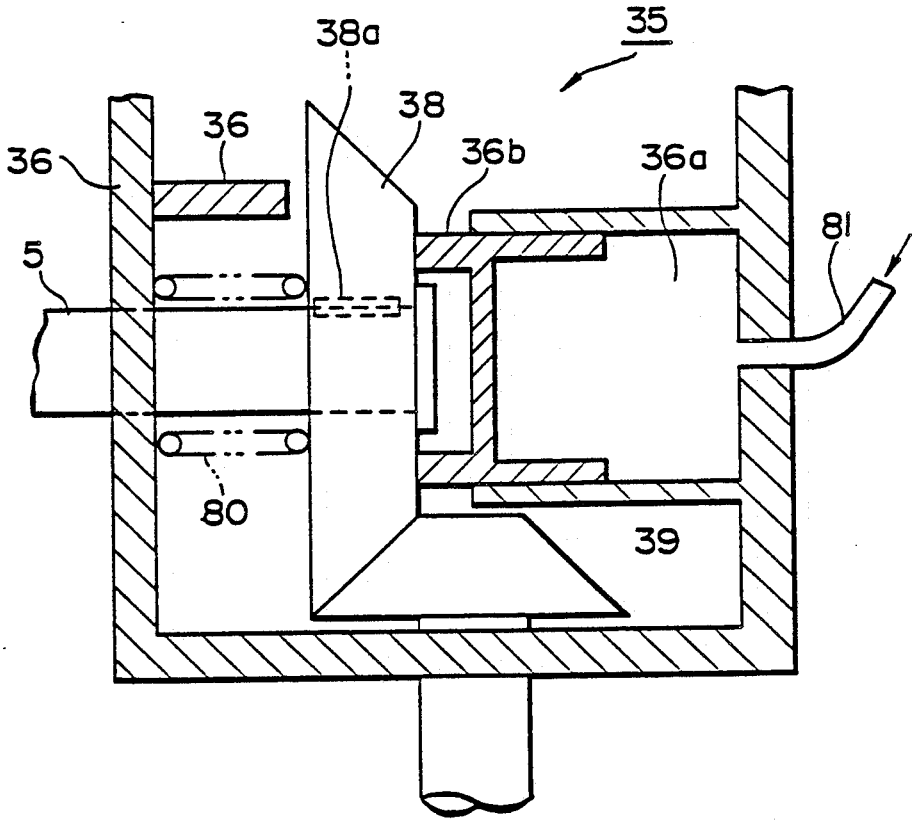
FIG. 22 is an enlarged view showing the essential portion of a second example according to the present invention.

Turning now to FIG. 22, there is shown another example of a mechanism 35 for converting the upward-and-downward movement to rotation, in which the same elements are provided with the same reference numerals and symbols as the above embodiments. The mechanism 35 of this example is designed to use a backlash of a pair of first and second bevel gears 38 and 39, respectively, to apply a vibration to the paint coated on a surface of the vehicle body W. The mechanism 35 comprises a housing 36 which is provided with a pressure chamber 36*a*. A piston 36*b* is then inserted into the pressure chamber 36*a* and is fixed to a forward end surface of the first bevel gear 38 which in turn is mounted movably to the rotary shaft 5 of the front rotation jig 1F in a longitudinal direction of the body W. A spring 60 is mounted between a rearward inner side surface of the housing 36 and a rearward side surface of the first bevel gear 38, thus urging the first bevel gear 38 in a forward direction. Into the pressure chamber 36*a* is intermittently fed compressed air through an air inlet tube 62. In the drawing, reference numeral 38*a* denotes a key and 38*c* denotes a stopper.

As shown in FIG. 22, a force for driving rotation is produced by an engagement of the chain 34 with the sprocket 31 so that a back clash always occurs by the sprocket 31 and the chain 34. The above arrangement for the mechanism 35 amplifies the back clash.

Figure 23:
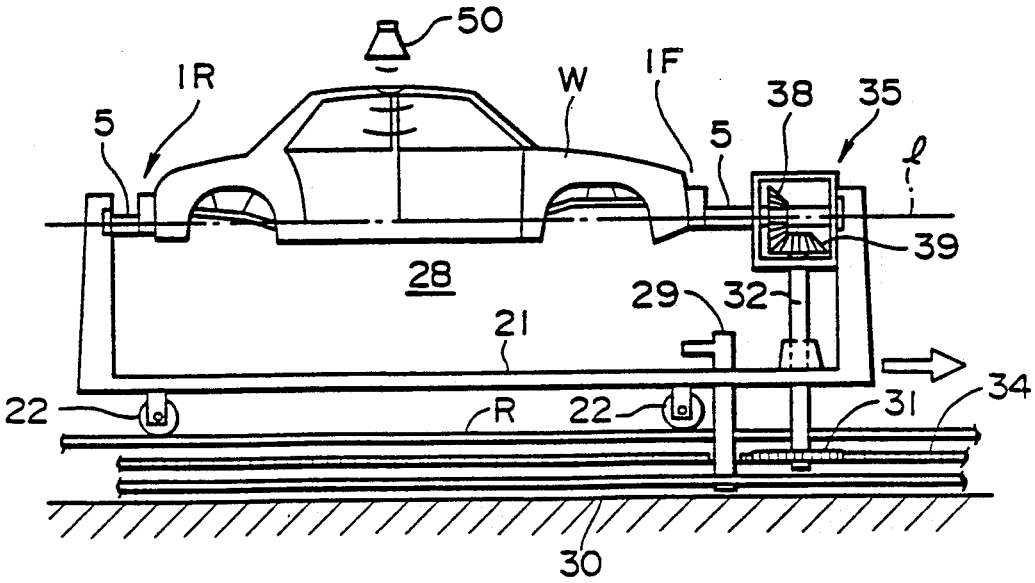
FIG. 23 is a side view showing a third example according to the present invention.

Turning further to FIG. 23, there is shown a further example of a system in which a vibration is provided on the paint coated on a surface of the vehicle body W. This example shows a speaker 50 that produces an impulse sound transmitted to the coat surface through air, thus creating a vibration to cause the paint to flow or sag and forming a uniform film thickness of the coat with a higher degree of flatness.

Figure 24:
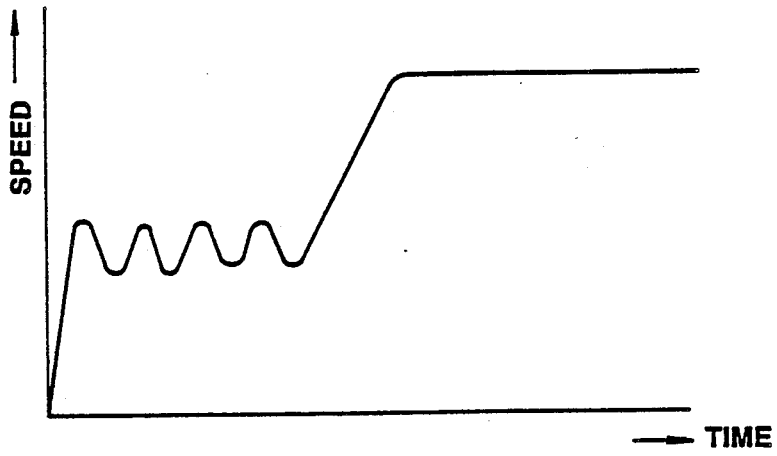
FIGS. 24 and 25 are each a graph showing the relationship of times vs. speeds with respect to a fourth example according to the present invention.
Figure 25:
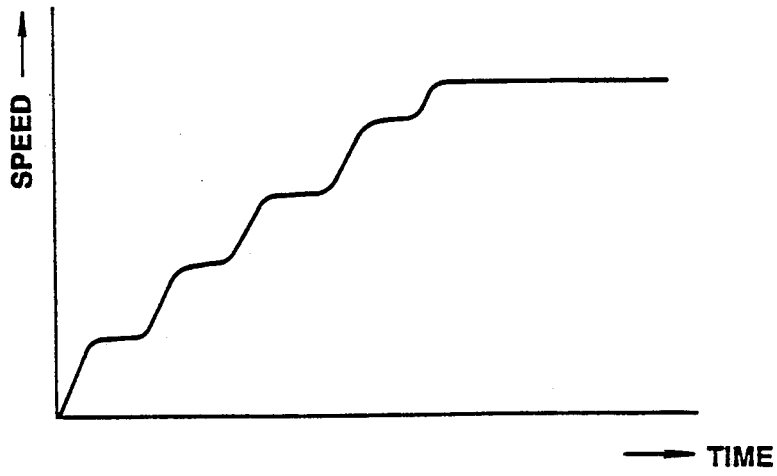

FIGS. 24 and 25 show each a still further example in which speeds for conveying the carriage D are varied, as shown therein, by changing the retracting action by the retractable wire 30. The speed of rotating the vehicle body W may be varied, for example, by deviating the horizontal axis in an upward or downward direction from gravity of the body W. While the running speeds of the carriage D are varied, the body W is rotated in the manner as have been described hereinabove.

Those examples as have been described hereinabove may be combined with the other examples in an appropriate manner.

Variants

If an overcoating step is carried out after an intercoating step, a wet rubbing treatment can be cancelled which is otherwise done after the baking step for the intercoat.

The rotation of the vehicle body W may be carried out either in the intercoating step or in the overcoating step. A final quality of the overcoat depends primarily upon the intercoat so that the rotation of the body W during the intercoating step provides a higher quality of the intercoat, thus cancelling the wet rubbing treatment. It is to be noted, however, that the rotation of the body W during the overcoating step can provide an overcoat surface in a higher quality even if no wet rubbing treatment would be made for the intercoat.

If the body W is rotated during the overcoating step and if an overcoating paint having a low sagging threshold value is coated in a thin film thickness, a paint with a color different from the overcoating paint may be used to see the color of the intercoat through the overcoat, thus providing a color different from the colors of the paints used.

Regardless of travel or suspension of the carriage D, the body W may be switched from a state of rotation of the carriage D to a state of suspension thereof or vice versa by an actuator for exclusive use, such as an air motor. A direction in which the body W is rotated may be changed by such an actuator. For example, as shown in FIG. 7, the sprocket 33 may be provided with first and second pairs of chains 34 engageable with each other from the opposite side in a radial direction, thus operatively driving each of the chains 34. With this arrangement, the rotation of the vehicle body W may be controlled according to the following operation modes: In a mode in which the first pair of chains 34 are suspended while the second pair of chains are released free, the vehicle body W is allowed to rotate in one direction as the carriage D runs. In a mode in which the first pair of chains and second chains are released free and the second pair of chains are suspended, the vehicle body W is allowed to rotate in the direction opposite to that in the mode as the carriage D runs. In a mode where both the first and second pairs of chains are released free, the vehicle body W are not allowed to rotate in association of the running of the carriage D. In a mode where the first pair of chains are driven in one direction and the second pair of chains are released free, the vehicle body W is allowed to rotate in one direction while the carriage D is suspended. In a mode in which the first pair of chains are driven in the other direction and the second pair of chains are released free (or the first pair of chains are released free and the second pair thereof are driven in the other direction), the vehicle body W is rotated in the direction opposite to in the mode even if the carriage D is suspended.

In the above cases, a rack bar may be likewise used in place of the chains. If the rack bars are disposed in a fixed state when the vehicle body W is rotated while the carriage D travels, they may be arranged in a constantly spaced relationship or in an arbitrarily spaced relationship on right-hand and left-hand rows, thus rotating the body W in an arbitrary direction and suspending the rotation of the body W at an arbitrary position.

The present invention will be described more in detail by way of examples.

EXAMPLE 1 a. Treatment of Coating Substrate

A cold rolled steel plate which has been usually used for vehicle bodies was subjected to the zinc phosphate treatment in conventional manner and the steel plate was then coated with an undercoating paint to cationic electrodeposition at 175° C. for 30 minutes, thus producing an undercoating with a film thickness of about 30 μm. The undercoating was then sprayed with an oil-free polyester intercoating paint with a gray color and baked at 140° C. for 25 minutes forming an intercoating with the film thickness of 35 μm.

b. Overcoating

As an overcoating paint, a paint of the type being dilutable with a solvent was sprayed on the intercoating in varying film thicknesses as shown in Table 1 below and treated under the following conditions:

(a) Paint (1) Agent: melamine alkid high solid thermosetting type (black, average molecular weight of main resin (2) Viscosity for spraying: 20 seconds (measured by Ford Cup #4 at 20° C.)

(3) Involatilizables: 48% by weight (4) Solvent: toluene, 25 parts by weight;

Solvesso 100, 25 parts by weight;

Solvesso 150, 50 parts by weight (5) Agent for preventing sags: cross-linked acrylic resin powders, 3% by weight based on the unvolatilizables (b) Film coater: Minibell (bell size: 60 mm; Lundsberg Japan, K.K.); sprayed once Revolutions, 1,8000 r.p.m.

Shaping air: 3.0 kg./cm$^2$

Voltage: 90 kv

Distance from gun: 30 cm (c) Atmosphere: temperature, 20°±2° C.; booth air velocity, 0.3±0.1 m/second (push-pull downward flow)

(d) Setting time/temperature: 10 minutes/20°±2° C.

(e) Baking temperature/time: 140° C./25 minutes

Speed of elevating temperatures: 8 minutes from 20° C. to 140° C.

(f) Rotating conditions: The substrate to be rotated in parallel to its sides about a horizontal axis in 75 cm apart from the central axis thereof For the setting step, the steel plate thus overcoated was then conveyed to a device as shown in FIG. 23 where a ultrasonic wave with a frequency of 23,000 Hz and an amplitude of 0.05 mm was applied. The application of the ultrasonic wave started in 3 minutes after the setting step started and continued for 20 seconds. During the application of the ultrasonic wave, the substrate was rotated at the rate of 30 rpm. The setting step is continued for 10 minutes, and thereafter the substrate was baked without application of the ultrasonic wave and rotation of the substrate.

Figure 27A:
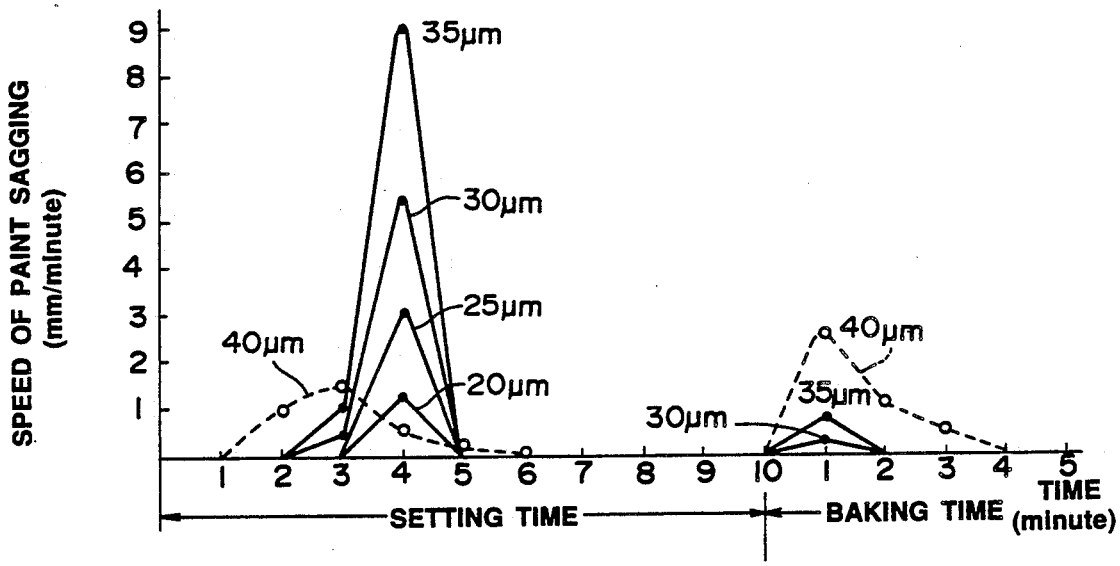
FIGS. 27(*a*) to 27(*f*) are each a graph showing speeds of paint sagging during the setting and baking steps without rotation of the substrate coated with a thermosetting paint in varying film thicknesses.
Figure 27:
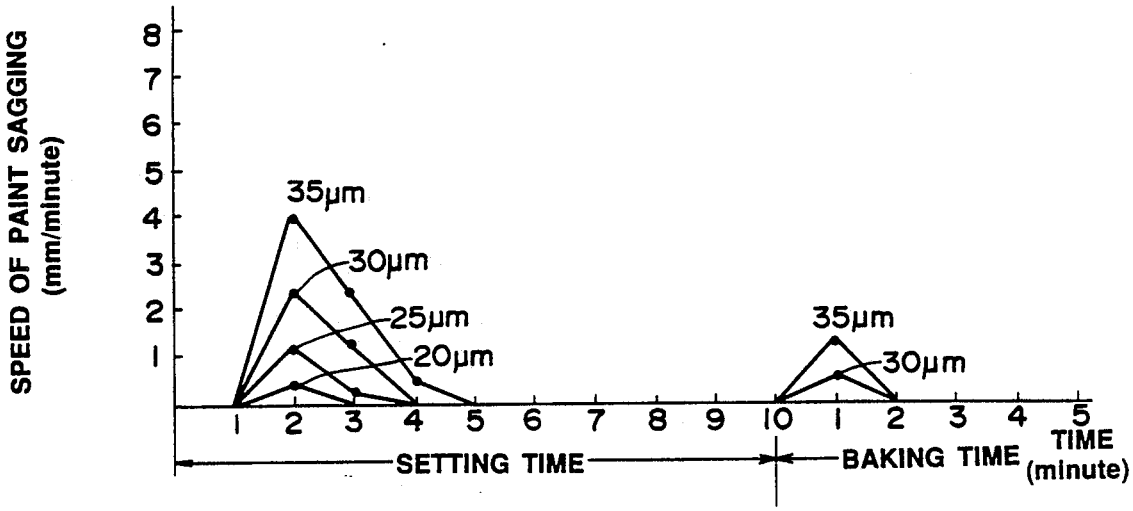
Figure 27C:
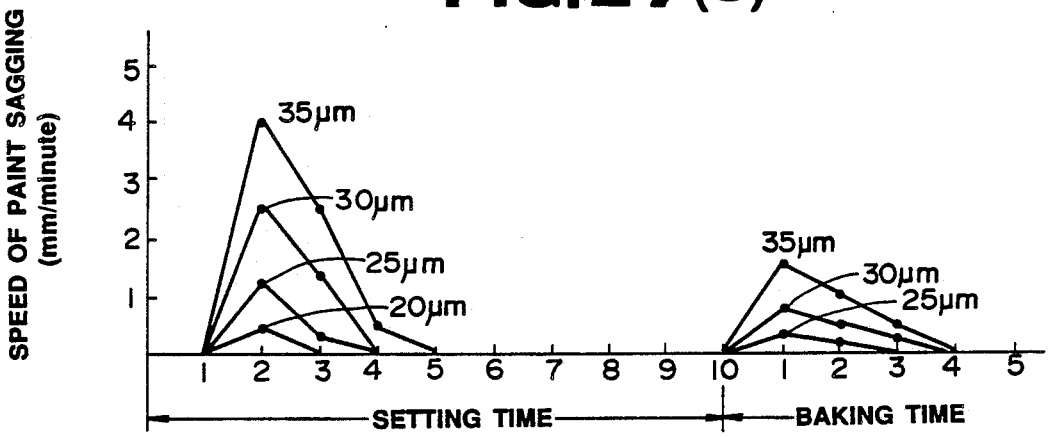
Figure 27D:
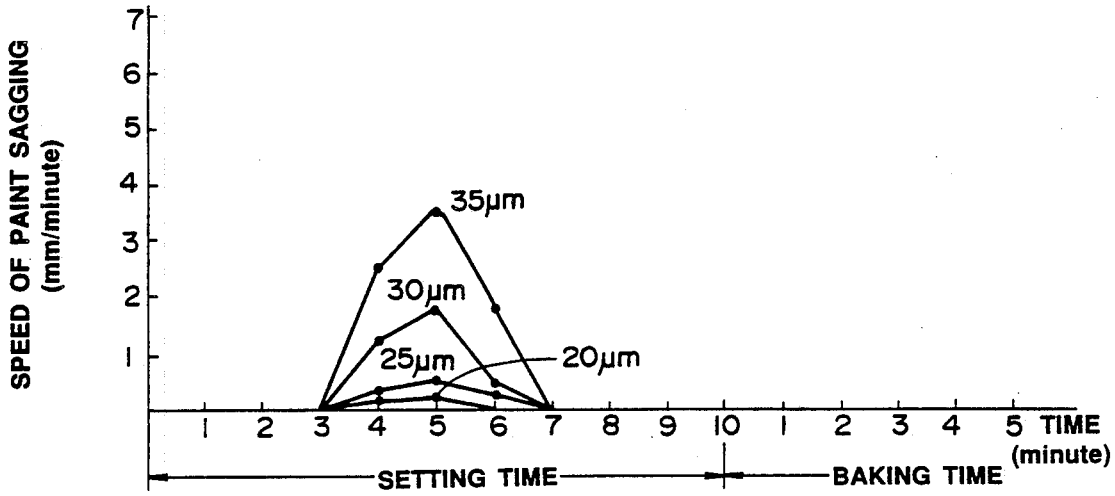
Figure 27E:
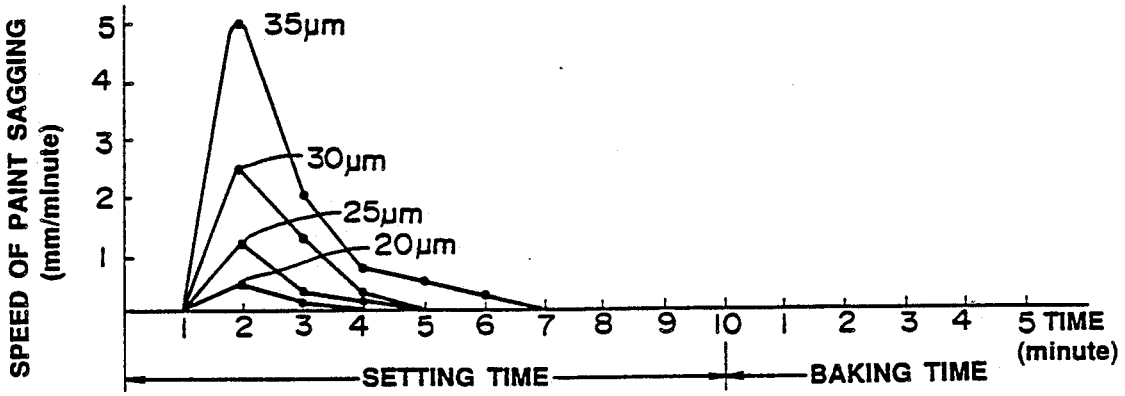
Figure 27F:
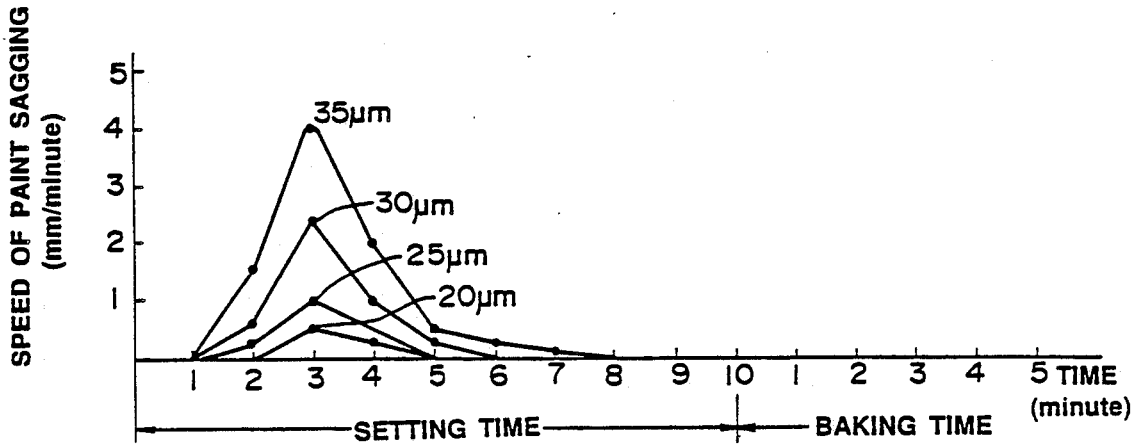

FIG. 27(*a*) shows speeds of paint sagging when the ultrasonic wave was applied in the same conditions as above yet without rotation of the substrate during the application of the ultrasonic wave. For reference, the paint coated in the film thickness of 40 μm was set and baked in the same manner as above as shown by the dashed line in FIG. 27(*a*), although no rotation was carried out.

Table 1 shows the results indicating the relationship of the film thicknesses vs. the speeds of rotation with the outside action applied during rotation. The values in the table are expressed in the PGD value. This is all the same for tables which follow.

TABLE 1

| Film Thickness (μ m) | Time of Vibration (sec) | Speed of Rotation (rpm) | | | | |
|---|---|---|---|---|---|---|
| | | 20 | 25 | 30 | 35 | 40 |
| 20 | 10 | 0.4 | 0.4 | 0.4 | 0.4 | 0.4 |

TABLE 1-continued

| Film Thickness (μ m) | Time of Vibration (sec) | Speed of Rotation (rpm) 20 | 25 | 30 | 35 | 40 |
|---|---|---|---|---|---|---|
| (0.3) | 20 | 0.4 | 0.4 | 0.4 | 0.4 | 0.4 |
| | 30 | 0.4 | 0.4 | 0.4 | 0.4 | 0.4 |
| 25 | 10 | 0.6 | 0.6 | 0.6 | 0.6 | 0.6 |
| (0.4) | 20 | 0.7 | 0.7 | 0.7 | 0.7 | 0.7 |
| | 30 | 0.7 | 0.7 | 0.7 | 0.7 | 0.7 |
| 30 | 10 | SAG | 0.7 | 0.7 | 0.7 | 0.7 |
| (0.5) | 20 | — | SAG | 0.8 | 0.8 | 0.8 |
| | 30 | — | — | 0.8 | 0.8 | 0.8 |
| 35 | 10 | SAG | SAG | 0.9 | 0.9 | SAG** |
| (0.6) | 20 | — | — | 1.0 | 1.0 | — |
| | 30 | — | — | 1.0 | 1.0 | — |

Notes:
( )-PGD value; without rotation and application of the outside action; vertical side finished
**-Sagged in a reverse direction due to centrifugal force

EXAMPLE 2

The steel plate was overcoated in varying film thicknesses as shown in Table 2 below and then treated in the same manner as in Example 1 with the exception that, in place of a ultrasonic wave, there was applied a vibration having a frequency of 240 Hz and an amplitude of 5.0 mm for three minutes in the setting step after 1 minute from the start of the setting step by traveling the carriage on wavy rails as shown in FIG. 20. During application of the vibration upwardly and downwardly in alternate directions, the rotation was carried out on the carriage at the rate of 15 rpm.

FIG. 27(*b*) shows speeds of paint sagging when the vibration was applied in the same conditions as above yet without rotation of the substrate during the application of the up-and-down vibration.

Table 2 shows the results indicating the relationship of the film thicknesses vs. the speeds of rotation with the outside action applied during rotation.

TABLE 2

| Film Thickness (μ m) | Time of Vibration (min) | Speed of Rotation (rpm) 5 | 10 | 15 | 20 | 25 |
|---|---|---|---|---|---|---|
| 20 | 1 | 0.3 | 0.3 | 0.3 | 0.3 | 0.3 |
| | 3 | 0.3 | 0.3 | 0.3 | 0.3 | 0.3 |
| | 5 | 0.3 | 0.3 | 0.3 | 0.3 | 0.3 |
| 25 | 1 | 0.5 | 0.5 | 0.5 | 0.5 | 0.5 |
| | 3 | 0.5 | 0.5 | 0.5 | 0.5 | 0.5 |
| | 5 | 0.5 | 0.5 | 0.5 | 0.5 | 0.5 |
| 30 | 1 | SAG | SAG | 0.6 | 0.6 | 0.6 |
| | 3 | — | — | 0.7 | 0.7 | 0.7 |
| | 5 | — | — | 0.7 | 0.7 | 0.7 |
| 35 | 1 | SAG | SAG | 0.8 | 0.8 | 0.8 |
| | 3 | — | — | 0.9 | 0.9 | 0.9 |
| | 5 | — | — | 0.9 | 0.9 | 0.9 |

EXAMPLE 3

The steel plate was overcoated in varying film thicknesses as shown in Table 3 below and then treated in the same manner as in Example 2 with the exception that the same vibration was additionally applied for five minutes just after the start of the baking step in the same manner as in Example 2 while rotating the substrate at the rate of 15 rpm.

FIG. 27(*c*) shows speed of paint sagging when the vibration was applied in the same conditions as above yet without rotation of the substrate during the application of the up-and-down vibration.

Table 3 shows the results indicating the relationship of the film thicknesses vs. the speeds of rotation with the outside action applied during rotation.

TABLE 3

| Film Thickness (μ m) | Time of Vibration (minutes) Setting Step | Baking Step | Speed of Rotation (rpm) 5 | 10 | 15 | 20 | 25 |
|---|---|---|---|---|---|---|---|
| 20 | 3 | 5 | 0.3 | 0.3 | 0.3 | 0.3 | 0.3 |
| 25 | 3 | 3 | 0.5 | 0.5 | 0.5 | 0.5 | 0.5 |
| | | 5 | 0.5 | 0.5 | 0.5 | 0.5 | 0.5 |
| 30 | 1 | 3 | SAG | 0.6 | 0.6 | 0.6 | 0.6 |
| | | 5 | — | 0.6 | 0.6 | 0.6 | 0.6 |
| | 3 | 3 | — | SAG | 0.8 | 0.8 | 0.8 |
| | | 5 | — | — | 0.8 | 0.8 | 0.8 |
| 35 | 1 | 3 | SAG | SAG | 0.8 | 0.8 | 0.8 |
| | | 5 | — | — | 0.8 | 0.8 | 0.8 |
| | 3 | 3 | — | — | 1.0 | 1.0 | 1.0 |
| | | 5 | — | — | 1.0 | 1.0 | 1.0 |

EXAMPLE 4

The steel plate was overcoated in varying film thicknesses as shown in Table 4 below and then treated in the same manner as in Example 1 with the exception that, in place of application of a ultrasonic wave, the substrate was heated with a high-frequency wave using a device as shown in FIG. 18. The setting step was carried out at 20° C. for 3 minutes and then by elevating the temperature of the substrate from 20° C. to 60° C. in 30 seconds. The heating was kept at that temperature for 1.5 minutes and then allowed to cool. The substrate was rotated at 30 rpm for about two minutes while it was heated. After the setting step for 10 minutes, the substrate was then heated again to 140° C.

FIG. 27(*d*) shows speeds of paint sagging when the vibration was applied in the same conditions as above yet without rotation of the substrate during the application of the outside action.

Table 4 shows the results indicating the relationship of the film thicknesses vs. the speeds of rotation with the outside action applied during rotation.

TABLE 4

| Film Thickness (μ m) | Time of Heating (min) | Speed of Rotation (rpm) 15 | 20 | 25 | 30 | 35 |
|---|---|---|---|---|---|---|
| 20 | 1 | 0.3 | 0.3 | 0.3 | 0.3 | 0.3 |
| | 2 | 0.3 | 0.3 | 0.3 | 0.3 | 0.3 |
| | 3 | 0.3 | 0.3 | 0.3 | 0.3 | 0.3 |
| 25 | 1 | 0.5 | 0.5 | 0.5 | 0.5 | 0.5 |
| | 2 | 0.5 | 0.5 | 0.5 | 0.5 | 0.5 |
| | 3 | 0.5 | 0.5 | 0.5 | 0.5 | 0.5 |
| 30 | 1 | 0.6 | 0.6 | 0.6 | 0.6 | 0.6 |
| | 2 | SAG | 0.8 | 0.8 | 0.8 | 0.8 |
| | 3 | — | 0.8 | 0.8 | 0.8 | 0.8 |
| 35 | 1 | SAG | 0.7 | 0.7 | 0.7 | 0.7 |
| | 2 | — | 0.9 | 0.9 | 0.9 | 0.9 |
| | 3 | — | 0.9 | 0.9 | 0.9 | 0.9 |

EXAMPLE 5

The steel plate was overcoated in varying film thicknesses as shown in Table 5 below and then treated in the same manner as in Example 1 with the exception that, in place of application of a ultrasonic wave, the substrate was heated with infrared rays using a device as shown in FIG. 17. The setting step was carried out at 20° C. for 1 minute and then by elevating the temperature of the substrate from 20° C. to 60° C. in one minute. The heating was kept at that temperature for three minutes and then allowed to cool. The substrate was rotated at 15 rpm for four minutes while it was heated. After the setting step for 10 minutes, the substrate was then heated again to 140° C.

FIG. 27(*e*) shows speeds of paint sagging when the vibration was applied in the same conditions as above yet without rotation of the substrate during the application of the outside action.

Table 5 shows the results indicating the relationship of the film thicknesses vs. the speeds of rotation with the outside action applied during rotation.

TABLE 5

| Film Thickness (μ m) | Time of Heating (min) | Speed of Rotation (rpm) 5 | 10 | 15 | 20 | 25 |
|---|---|---|---|---|---|---|
| 20 | 2 | 0.3 | 0.3 | 0.3 | 0.3 | 0.3 |
| | 4 | 0.3 | 0.3 | 0.3 | 0.3 | 0.3 |
| | 6 | 0.3 | 0.3 | 0.3 | 0.3 | 0.3 |
| 25 | 2 | 0.5 | 0.5 | 0.5 | 0.5 | 0.5 |
| | 4 | 0.5 | 0.5 | 0.5 | 0.5 | 0.5 |
| | 6 | 0.5 | 0.5 | 0.5 | 0.5 | 0.5 |
| 30 | 2 | SAG | 0.7 | 0.7 | 0.7 | 0.7 |
| | 4 | — | 0.7 | 0.7 | 0.7 | 0.7 |
| | 6 | — | 0.7 | 0.7 | 0.7 | 0.7 |
| 35 | 2 | — | 0.9 | 0.9 | 0.9 | 0.9 |
| | 4 | — | 0.9 | 0.9 | 0.9 | 0.9 |
| | 6 | — | 0.9 | 0.9 | 0.9 | 0.9 |

EXAMPLE 6

The steel plate was overcoated in varying film thicknesses as shown in Table 6 below and then treated in the same manner as in Example 1 with the exception that, in place of application of a ultrasonic wave, the substrate was heated with hot air using a device as shown in FIG. 19. The setting step was carried out at 20° C. for 1 minute and then by elevating the temperature of the substrate from 20° C. to 60° C. in three minutes. The heating was kept at that temperature for one minute and then allowed to cool. The substrate was rotated at 10 rpm for four minutes while it was heated. After the setting step for 10 minutes, the substrate was then heated again to 140° C.

FIG. 27(*f*) shows speeds of paint sagging when the vibration was applied in the same conditions as above yet without rotation of the substrate during the application of the outside action.

Table 6 shows the results indicating the relationship of the film thicknesses vs. the speeds of rotation with the outside action applied during rotation.

TABLE 6

| Film Thickness (μ m) | Time of Heating (min) | Speed of Rotation (rpm) 5 | 10 | 15 | 20 | 25 |
|---|---|---|---|---|---|---|
| 20 | 4 | 0.3 | 0.3 | 0.3 | 0.3 | 0.3 |
| | 6 | 0.3 | 0.3 | 0.3 | 0.3 | 0.3 |
| | 8 | 0.3 | 0.3 | 0.3 | 0.3 | 0.3 |
| 25 | 4 | 0.5 | 0.5 | 0.5 | 0.5 | 0.5 |
| | 6 | 0.5 | 0.5 | 0.5 | 0.5 | 0.5 |
| | 8 | 0.5 | 0.5 | 0.5 | 0.5 | 0.5 |
| 30 | 4 | 0.7 | 0.7 | 0.7 | 0.7 | 0.7 |
| | 6 | 0.7 | 0.7 | 0.7 | 0.7 | 0.7 |

TABLE 6-continued

| Film Thickness (μ m) | Time of Heating (min) | Speed of Rotation (rpm) 5 | 10 | 15 | 20 | 25 |
|---|---|---|---|---|---|---|
| | 8 | 0.7 | 0.7 | 0.7 | 0.7 | 0.7 |
| 35 | 4 | 0.9 | 0.9 | 0.9 | 0.9 | 0.9 |
| | 6 | 0.9 | 0.9 | 0.9 | 0.9 | 0.9 |
| | 8 | 0.9 | 0.9 | 0.9 | 0.9 | 0.9 |

EXAMPLE 7

A cold rolled steel plate was overcoated in varying film thicknesses as shown in Table 7 below in the same manner as in Example 1 using a two-component liquid urethane paint with the exception of treating conditions as follows:

(a) Paint:

(i) Main agent: acrylic resin (black; average weight, 2,500)

(ii) Curing agent: polyisocyate (iii) Ratio of main agent to curing agent: 7 to 1

(iv) Viscosity of spraying: 16 seconds (when measured by Ford Cup #4 at 20° C., without a sag preventing agent)

(v) Unvolatilizables: 54% by weight (vi) Solvent: ethyl acetate, 15 parts by weight, butyl acetate, 55 parts by weight, Cellosolve acetate, 30 parts by weight (b) Coating and drying conditions: The same as in Example 1 except the baking step carried out at 90° C. for 25 minutes with the temperature accelerated from 20° C. to 90° C. in 5 minutes (c) Film thickness at sagging limit: 45 μm The substrate overcoated above was then tested for its coating performance in substantially the same manner as in Example 1.

Figure 28A:
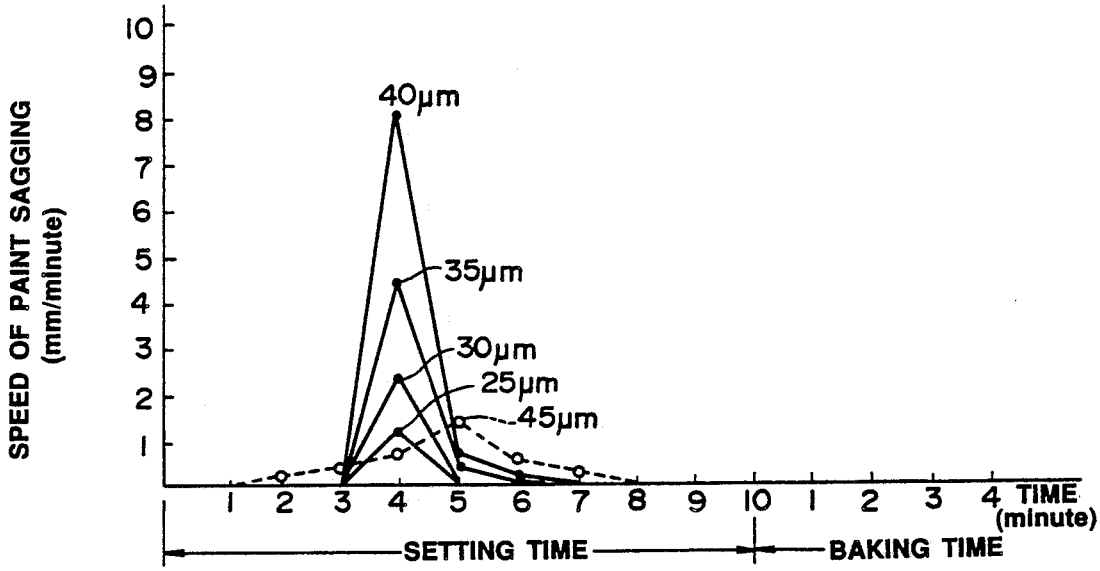
FIGS. 28(*a*) to 28(*e*) are each a graph showing speeds of paint sagging during the setting and baking steps without rotation of the substrate coated with a two-liquid type urethane paint in varying film thicknesses.
Figure 28:
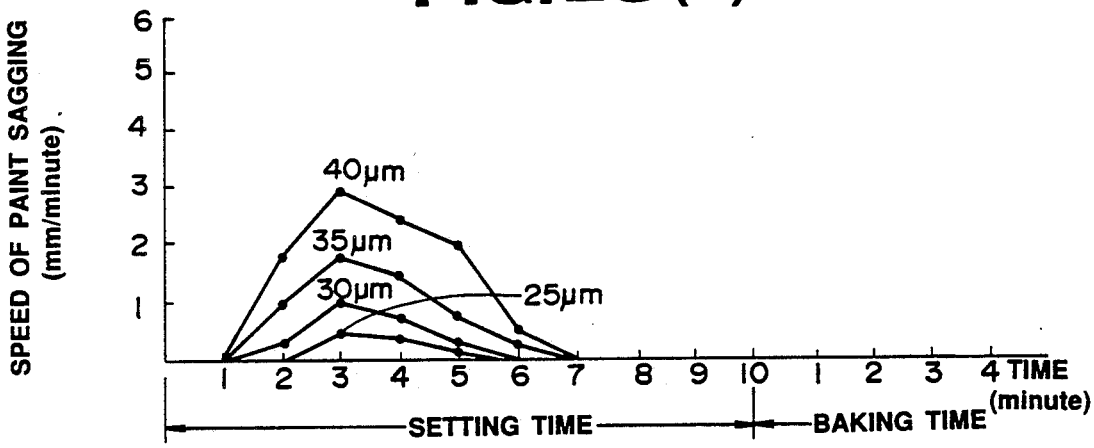
Figure 28:
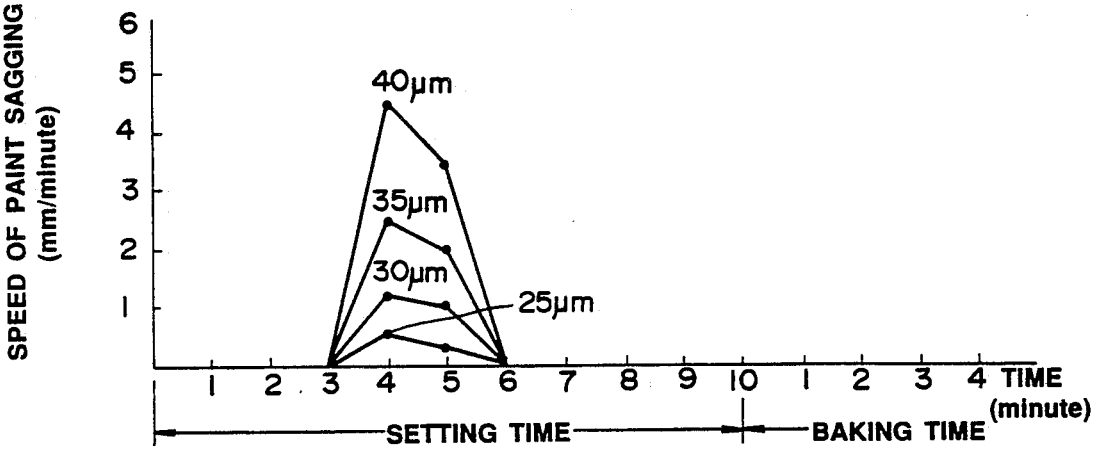
Figure 28D:
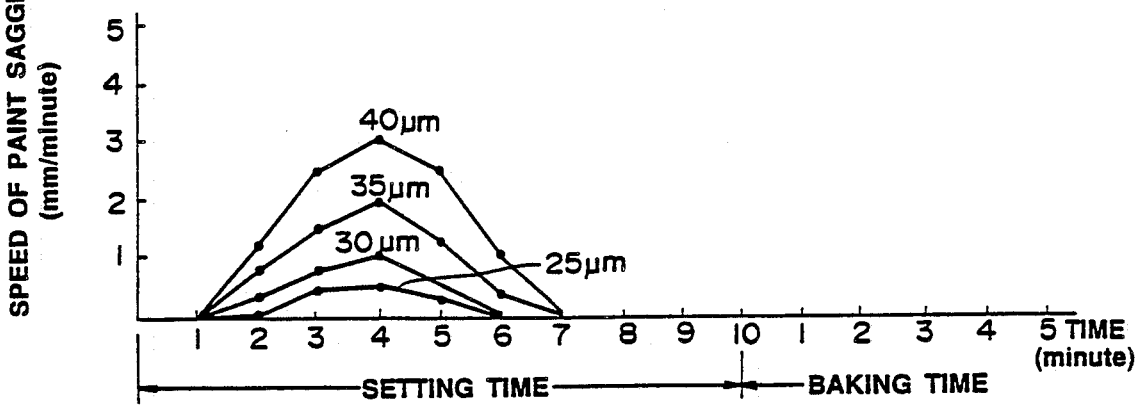
Figure 28E:
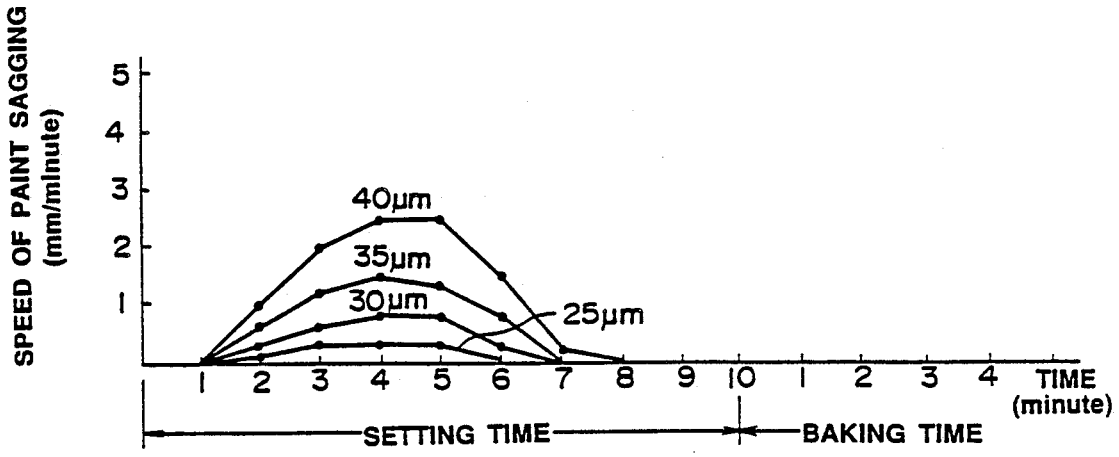

FIG. 28(*a*) shows speeds of paint sagging when the vibration was applied in the same conditions as above yet without rotation of the substrate during the application of the outside action. In FIG. 28(*a*), the dashed line indicates a coating in a film thickness of 45 μm which was set and baked without application of the outside action and rotation.

Table 7 shows the results indicating the relationship of the film thicknesses vs. the speeds of rotation with the outside action applied during rotation.

TABLE 7

| Film Thickness (μ m) | Time of Vibration (sec) | Speed of Rotation (rpm) 10 | 15 | 20 | 25 | 30 |
|---|---|---|---|---|---|---|
| 25 | 10 | 0.5 | 0.5 | 0.5 | 0.5 | 0.5 |
| (0.4) | 20 | 0.5 | 0.5 | 0.5 | 0.5 | 0.5 |
| | 30 | 0.5 | 0.5 | 0.5 | 0.5 | 0.5 |
| 30 | 10 | 0.6 | 0.6 | 0.6 | 0.6 | 0.6 |
| (0.5) | 20 | 0.6 | 0.6 | 0.6 | 0.6 | 0.6 |
| | 30 | 0.6 | 0.6 | 0.6 | 0.6 | 0.6 |
| 35 | 10 | SAG | SAG | 0.7 | 0.7 | 0.7 |
| (0.6) | 20 | — | — | 0.9 | 0.9 | 0.9 |
| | 30 | — | — | 0.9 | 0.9 | 0.9 |
| 40 | 10 | SAG | SAG | SAG | 0.9 | 0.9 |
| (0.7) | 20 | — | — | — | 1.0 | 1.0 |
| | 30 | — | — | — | 1.0 | 1.0 |

Notes:
( )- PGD value; without rotation and application of the outside action; vertical side finished

EXAMPLE 8

The steel plate was overcoated in varying film thicknesses as shown in Table 8 below and then treated in the same manner as in Example 2 with the exception that, in place of a ultrasonic wave, there was applied a vibration having a frequency of 240 Hz and an amplitude of 5.0 mm for three minutes in the setting step after 1 minute from the start of the setting step by traveling the carriage on wavy rails as shown in FIG. 20. During application of the vibration upwardly and downwardly in alternate directions, the rotation was carried out at the rate of 15 rpm.

FIG. 28(*b*) shows speeds of paint sagging when the vibration was applied in the same conditions as above yet without rotation of the substrate during the application of the up-and-down vibration.

Table 8 shows the results indicating the relationship of the film thicknesses vs. the speeds of rotation with the outside action applied during rotation.

TABLE 8

| Film Thickness (μ m) | Time of Vibration (min) | Speed of Rotation (rpm) 10 | 15 | 20 | 25 | 30 |
|---|---|---|---|---|---|---|
| 25 | 1 | 0.4 | 0.4 | 0.4 | 0.4 | 0.4 |
| | 3 | 0.5 | 0.5 | 0.5 | 0.5 | 0.5 |
| | 5 | 0.5 | 0.5 | 0.5 | 0.5 | 0.5 |
| 30 | 1 | 0.5 | 0.5 | 0.5 | 0.5 | 0.5 |
| | 3 | 0.6 | 0.6 | 0.6 | 0.6 | 0.6 |
| | 5 | 0.6 | 0.6 | 0.6 | 0.6 | 0.6 |
| 35 | 1 | 0.7 | 0.7 | 0.7 | 0.7 | 0.7 |
| | 3 | 0.9 | 0.9 | 0.9 | 0.9 | 0.9 |
| | 5 | 0.9 | 0.9 | 0.9 | 0.9 | 0.9 |
| 40 | 1 | SAG | 0.9 | 0.9 | 0.9 | 0.9 |
| | 3 | — | 1.0 | 1.0 | 1.0 | 1.0 |
| | 5 | — | 1.0 | 1.0 | 1.0 | 1.0 |

EXAMPLE 9

The steel plate was overcoated in varying film thicknesses as shown in Table 9 below and then treated in the same manner as in Example 4 with the exception that, in place of application of a ultrasonic wave, the substrate was heated with a high-frequency wave. The setting step was carried out by placing the substrate in a device as shown in FIG. 18 at 20° C. for 3 minutes and then by elevating the temperature of the substrate to 60° C. in 30 seconds. The heating was kept at that temperature for 1.5 minutes and then allowed to cool. The substrate was rotated in 30 rpm for about two minutes while it was heated. After the setting step for 10 minutes, the substrate was then heated again to 140° C.

FIG. 28(*c*) shows speeds of paint sagging when the vibration was applied in the same conditions as above yet without rotation of the substrate during the application of the outside action.

Table 9 shows the results indicating the relationship of the film thicknesses vs. the speeds of rotation with the outside action applied during rotation.

TABLE 9

| Film Thickness (μ m) | Time of Heating (min) | Speed of Rotation (rpm) 10 | 15 | 20 | 25 | 30 |
|---|---|---|---|---|---|---|
| 25 | 1 | 0.4 | 0.4 | 0.4 | 0.4 | 0.4 |
| | 2 | 0.4 | 0.4 | 0.4 | 0.4 | 0.4 |

TABLE 9-continued

| Film Thickness (μ m) | Time of Heating (min) | Speed of Rotation (rpm) 10 | 15 | 20 | 25 | 30 |
|---|---|---|---|---|---|---|
| | 3 | 0.4 | 0.4 | 0.4 | 0.4 | 0.4 |
| 30 | 1 | 0.6 | 0.6 | 0.6 | 0.6 | 0.6 |
| | 2 | 0.6 | 0.6 | 0.6 | 0.6 | 0.6 |
| | 3 | 0.6 | 0.6 | 0.6 | 0.6 | 0.6 |
| 35 | 1 | 0.7 | 0.7 | 0.7 | 0.7 | 0.7 |
| | 2 | 0.7 | 0.7 | 0.7 | 0.7 | 0.7 |
| | 3 | 0.7 | 0.7 | 0.7 | 0.7 | 0.7 |
| 40 | 1 | SAG | SAG | 0.9 | 0.9 | 0.9 |
| | 2 | — | — | 0.9 | 0.9 | 0.9 |
| | 3 | — | — | 0.9 | 0.9 | 0.9 |

EXAMPLE 10

The steel plate was overcoated in varying film thicknesses as shown in Table 10 below and then treated in the same manner as in Example 7 with the exception that, in place of application of a ultrasonic wave, the substrate was heated with infrared rays using a device as shown in FIG. 18. The setting step was carried out at 20° C. for one minute and then by elevating the temperature of the substrate from 20° C. to 60° C. in one minute. The heating was kept at that temperature for 1.5 minutes and then allowed to cool. The substrate was rotated at 15 rpm for four minutes while it was heated. After the setting step for 10 minutes, the substrate was then heated again to 140° C.

FIG. 28(*d*) shows speeds of paint sagging when the vibration was applied in the same conditions as above yet without rotation of the substrate during the application of the outside action.

Table 10 shows the results indicating the relationship of the film thicknesses vs. the speeds of rotation with the outside action applied during rotation.

TABLE 10

| Film Thickness (μ m) | Time of Heating (min) | Speed of Rotation (rpm) 10 | 15 | 20 | 25 | 30 |
|---|---|---|---|---|---|---|
| 25 | 2 | 0.5 | 0.5 | 0.5 | 0.5 | 0.5 |
| | 4 | 0.5 | 0.5 | 0.5 | 0.5 | 0.5 |
| | 6 | 0.5 | 0.5 | 0.5 | 0.5 | 0.5 |
| 30 | 2 | 0.6 | 0.6 | 0.6 | 0.6 | 0.6 |
| | 4 | 0.6 | 0.6 | 0.6 | 0.6 | 0.6 |
| | 6 | 0.6 | 0.6 | 0.6 | 0.6 | 0.6 |
| 35 | 2 | 0.7 | 0.7 | 0.7 | 0.7 | 0.7 |
| | 4 | 0.9 | 0.9 | 0.9 | 0.9 | 0.9 |
| | 6 | 0.9 | 0.9 | 0.9 | 0.9 | 0.9 |
| 40 | 2 | SAG | 0.9 | 0.9 | 0.9 | 0.9 |
| | 4 | — | 1.0 | 1.0 | 1.0 | 1.0 |
| | 6 | — | 1.0 | 1.0 | 1.0 | 1.0 |

EXAMPLE 11

The steel plate was overcoated in varying film thicknesses as shown in Table 11 below and then treated in the same manner as in Example 7 with the exception that, in place of application of a ultrasonic wave, the substrate was heated with hot air using a device as shown in FIG. 19. The setting step was carried out at 20° C. for one minute and then by elevating the temperature of the substrate from 20° C. to 60° C. in three minutes. The heating was kept at that temperature for one minute and then allowed to cool. The substrate was rotated at 10 rpm for about four minutes while it was heated. After the setting step for 10 minutes, the substrate was then heated again to 140° C.

FIG. 28(*e*) shows speeds of paint sagging when the vibration was applied in the same conditions as above yet without rotation of the substrate during the application of the outside action. Table 11 shows the results indicating the relationship of the film thicknesses vs. the speeds of rotation with the outside action applied during rotation.

TABLE 11

| Film Thickness (μ m) | Time of Heating (min) | Speed of Rotation (rpm) 10 | 15 | 20 | 25 | 30 |
|---|---|---|---|---|---|---|
| 25 | 2 | 0.5 | 0.5 | 0.5 | 0.5 | 0.5 |
| | 4 | 0.5 | 0.5 | 0.5 | 0.5 | 0.5 |
| | 6 | 0.5 | 0.5 | 0.5 | 0.5 | 0.5 |
| 30 | 2 | 0.6 | 0.6 | 0.6 | 0.6 | 0.6 |
| | 4 | 0.6 | 0.6 | 0.6 | 0.6 | 0.6 |
| | 6 | 0.6 | 0.6 | 0.6 | 0.6 | 0.6 |
| 35 | 2 | 0.7 | 0.7 | 0.7 | 0.7 | 0.7 |
| | 4 | 0.9 | 0.9 | 0.9 | 0.9 | 0.9 |
| | 6 | 0.9 | 0.9 | 0.9 | 0.9 | 0.9 |
| 40 | 2 | SAG | 0.9 | 0.9 | 0.9 | 0.9 |
| | 4 | SAG | 1.0 | 1.0 | 1.0 | 1.0 |
| | 6 | SAG | 1.0 | 1.0 | 1.0 | 1.0 |

EXAMPLE 12

A cold rolled steel plate was undercoated and then intercoated in substantially the same manner as in Example 1.

The plate so intercoated was then overcoated with a powder paint in varying film thicknesses as shown in Table 12 and baked in substantially the same manner as in Example 1 unless otherwise stated hereinbelow:

(a) Paint: Acrylic powder paint (average molecular weight: 4,000; black)

(b) Powder spray gun by electrodeposition: 1 stage coating on a surface extending vertically (c) Baking temperature/time: 150° C./20 minutes; accelerated from 20° C. to 150° C. in 10 minutes (d) Film thickness at sagging threshold value: 100 μm The substrate was subjected to a vibration by applying a ultrasonic wave with a frequency of 23,000 Hz and an amplitude of 0.05 mm was applied after one minute from the start of the baking step. During the application of the ultrasonic wave, the substrate was rotated at the rate of 20 rpm.

Figure 29A:
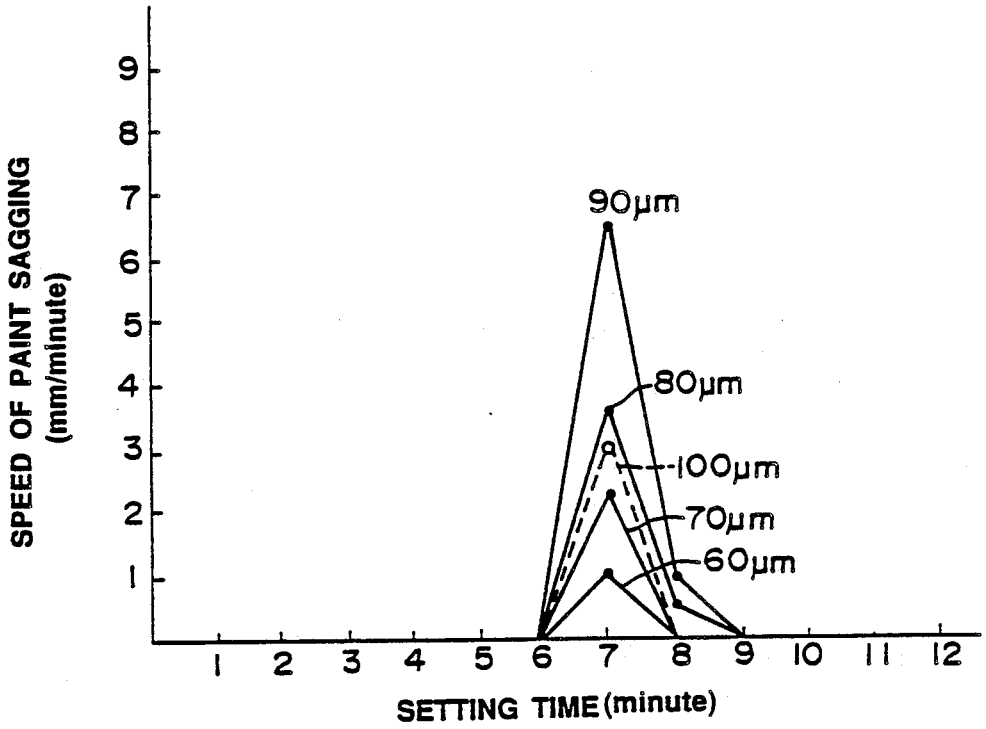
FIG. 29(*a*) and 29(*b*) are each a graph showing speeds of paint sagging during the baking step without rotation of the substrate coated with a powder paint in varying film thicknesses.
Figure 29B:
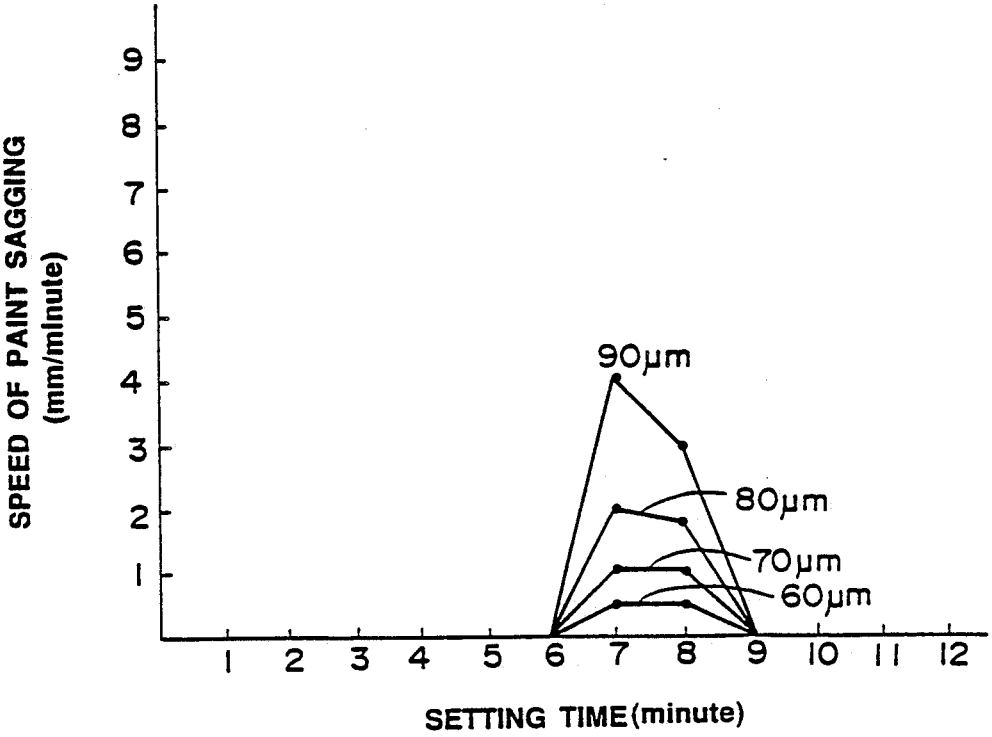

FIG. 29(*a*) shows speeds of paint sagging when the ultrasonic wave was applied in the same conditions as above yet without rotation of the substrate during the application of the ultrasonic wave. As shown in FIG. 27(*a*), the paint was coated in the film thickness of 100 μm and baked in the same manner as hereinabove, although no rotation was carried out.

Table 12 shows the results indicating the relationship of the film thicknesses vs. the speeds of rotation with the outside action applied during rotation.

It is to be noted herein that the use of powder paints as in this embodiment does not require the setting step so that a substrate coated with powder paints may be conveyed directly to the baking step from the coating step.

TABLE 12

| Film Thickness (μ m) | Time of Vibration (sec) | Speed of Rotation (rpm) 10 | 15 | 20 | 25 | 30 |
|---|---|---|---|---|---|---|
| 60 | 30 | 0.1 | 0.1 | 0.1 | 0.1 | 0.1 |
| (0.1) | 60 | 0.1 | 0.1 | 0.1 | 0.1 | 0.1 |
| | 90 | 0.1 | 0.1 | 0.1 | 0.1 | 0.1 |
| 70 | 30 | 0.3 | 0.3 | 0.3 | 0.3 | 0.3 |
| (0.3) | 60 | 0.4 | 0.4 | 0.4 | 0.4 | 0.4 |
| | 90 | 0.4 | 0.4 | 0.4 | 0.4 | 0.4 |
| 80 | 30 | 0.5 | 0.5 | 0.5 | 0.5 | 0.5 |
| (0.4) | 60 | 0.7 | 0.7 | 0.7 | 0.7 | 0.7 |
| | 90 | 0.7 | 0.7 | 0.7 | 0.7 | 0.7 |
| 90 | 30 | SAG | 0.8 | 0.8 | 0.8 | 0.8 |
| (0.5) | 60 | — | SAG | 0.9 | 0.9 | 0.9 |
| | 90 | — | — | 0.9 | 0.9 | 0.9 |

Notes:
( )-PGD value; without rotation and application of the outside action; vertical side finished

EXAMPLE 13

The steel plate was overcoated in varying film thicknesses as shown in Table 13 below and then treated in the same manner as in Example 12 with the exception that, in place of a ultrasonic wave, there was applied a vibration having a frequency of 240 Hz and an amplitude of 5.0 mm for three minutes in the baking step after five minutes from the start of the baking step by traveling the carriage on wavy rails as shown in FIG. 20. During application of the vibration upwardly and downwardly in alternate directions, the rotation was carried out at the rate of 15 rpm.

FIG. 29(*b*) shows speeds of paint sagging when the vibration was applied in the same conditions as above yet without rotation of the substrate during the application of the up-and-down vibration.

Table 13 shows the results indicating the relationship of the film thicknesses vs. the speeds of rotation with the outside action applied during rotation.

TABLE 13

| Film Thickness (μ m) | Time of Vibration (min) | Speed of Rotation (rpm) 10 | 15 | 20 | 25 | 30 |
|---|---|---|---|---|---|---|
| 60 | 1 | 0.1 | 0.1 | 0.1 | 0.1 | 0.1 |
| | 3 | 0.1 | 0.1 | 0.1 | 0.1 | 0.1 |
| | 5 | 0.1 | 0.1 | 0.1 | 0.1 | 0.1 |
| 70 | 1 | 0.3 | 0.3 | 0.3 | 0.3 | 0.3 |
| | 3 | 0.4 | 0.4 | 0.4 | 0.4 | 0.4 |
| | 5 | 0.4 | 0.4 | 0.4 | 0.4 | 0.4 |
| 80 | 1 | 0.6 | 0.6 | 0.6 | 0.6 | 0.6 |
| | 3 | 0.7 | 0.7 | 0.7 | 0.7 | 0.7 |
| | 5 | 0.7 | 0.7 | 0.7 | 0.7 | 0.7 |
| 90 | 1 | 0.8 | 0.8 | 0.8 | 0.8 | 0.8 |
| | 3 | SAG | 1.0 | 1.0 | 1.0 | 1.0 |
| | 5 | — | 1.0 | 1.0 | 1.0 | 1.0 |

It is to be understood that the foregoing text and drawings relates to embodiments of the present invention given by way of examples but not limitations. Various other embodiments and variants are possible within the spirit and scope of the present invention.

What is claimed is:

1. A coating method comprising:

a coating step for spraying a surface of a substrate with a paint; and a drying step for drying the paint sprayed on the surface of the substrate;

wherein the paint is sprayed during the coating step to form a coating a film thickness which is thinner than a thickness at which the coat begins to sag in either the coating step or the drying step;

wherein an action is applied from outside the substrate in at least one of the coating and drying steps so as to cause the paint coated on the substrate to flow or sag in the drying step; and wherein the substrate is rotated about an axis extending substantially horizontally in a longitudinal direction of the substrate while the paint of the coat flows as a result of the application of the action from the outside at a speed which is high enough to rotate the substrate before the paint of the coat substantially sags due to gravity yet which is low enough so as to cause no sagging as a result of centrifugal force.

2. A coating method as claimed in claim 1, wherein the drying step comprises a setting step and a baking step and an ambient temperature in the setting step is lower than the temperature during the baking step.

3. A coating method as claimed in claim 2, wherein the action is applied by heating the paint coated thereon in the setting step.

4. A coating method as claimed in claim 3, where the heating is effected from the inside of the substrate.

5. A coating method as claimed in claim 3, wherein the paint coated thereon is heated at an ambient temperature higher than the temperature set in the setting step.

6. A coating method as claimed in claim 3, wherein the heating is effected by an infrared panel.

7. A coating method as claimed in claim 3, wherein the heating is effected by a high-frequency induction coil.

8. A coating method as claimed in claim 4, wherein the action is applied by feeding hot air toward inside the substrate.

9. A coating method as claimed in claim 2, wherein no rotation of the substrate is carried out in the baking step.

10. A coating method as claimed in claim 2, wherein the rotation of the substrate is carried out in the baking step.

11. A coating method as claimed in claim 2, wherein a paint is a thermosetting paint containing a solvent.

12. A coating method as claimed in claim 1, wherein the rotation of the substrate is carried out intermittently.

13. A coating method as claimed in claim 1, wherein the action is a vibration during the drying step applied within the paint coated on the substrate.

14. A coating method as claim in claim 13, wherein the drying step comprises setting and baking steps, and an ambient temperature in the setting step is set to be lower then the ambient temperature during the baking step.

15. A coating method as claimed in claim 14, wherein the vibration is produced both in the setting and baking steps.

16. A coating method as claimed in claim 13, wherein the vibration is produced in upward and downward directions.

17. A coating method as claimed in claim 13, wherein the vibration is produced acoustically.

18. A coating method as claimed in claim 1, wherein the coating substrate is a vehicle body.

19. A coating method as claim in claim 18, wherein the horizontal axis of the body is set to extend horizontally in a longitudinal direction thereof.

20. A coating method as claimed in claim 2, wherein the horizontal axis is set to pass through the center of gravity of the coating substrate.

21. A coating method as claimed in claim 1, wherein the paint is a thermosetting paint.

22. A coating method as claimed in claim 1, wherein the rotation of the substrate is carried out continuously in one predetermined direction.

23. A coating method as claimed in claim 1, wherein the rotation of the substrate is carried out alternatively first in one direction and then in the opposite direction.

24. A coating method as claimed in claim 13, wherein the paint is dried in the drying step while the substrate is conveyed by a conveyance means; and the conveyance means is provided with a vibration-applying means for applying a vibration as an action from outside.

25. A coating method as claimed in claim 14, wherein the vibration is applied in the setting step alone.

26. A coating method as claimed in claim 25, wherein the paint is a two-component curing paint comprising a major component and a curing agent.

27. A coating method as claimed in claim 14, wherein the vibration is applied in the baking step alone.

28. A coating method as claimed in claim 27, wherein the paint is a powder paint.

* * * * *